US011681247B2

(12) United States Patent
Kobayashi et al.

(10) Patent No.: US 11,681,247 B2
(45) Date of Patent: Jun. 20, 2023

(54) IMAGE FORMING APPARATUS THAT CAN ENHANCE USABILITY BY REDUCING THE NUMBER OF TIMES A CHART IS PLACED ON A READING DEVICE

(71) Applicant: CANON KABUSHIKI KAISHA, Tokyo (JP)

(72) Inventors: Masato Kobayashi, Chiba (JP); Wataru Kato, Chiba (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 17/545,898

(22) Filed: Dec. 8, 2021

(65) Prior Publication Data

US 2022/0197192 A1 Jun. 23, 2022

(30) Foreign Application Priority Data

Dec. 18, 2020 (JP) ..... JP2020-210847
May 14, 2021 (JP) ..... JP2021-082768

(51) Int. Cl.
*G03G 15/16* (2006.01)
*G03G 15/00* (2006.01)
*G03G 15/02* (2006.01)

(52) U.S. Cl.
CPC ..... *G03G 15/1665* (2013.01); *G03G 15/0266* (2013.01); *G03G 15/1645* (2013.01); *G03G 15/1675* (2013.01); *G03G 15/5041* (2013.01); *G03G 15/5062* (2013.01)

(58) Field of Classification Search
CPC ..... G03G 15/0266; G03G 15/1645; G03G 15/1675; G03G 15/5041; G03G 15/5062
USPC ..... 399/15, 66
See application file for complete search history.

(56) References Cited

U.S. PATENT DOCUMENTS

| | | | | |
|---|---|---|---|---|
| 10,990,051 | B2 * | 4/2021 | Omata et al. | G03G 15/5062 |
| 11,126,115 | B2 * | 9/2021 | Sueoka | G03G 15/1675 |
| 2011/0292457 | A1 | 12/2011 | Miyata | |
| 2014/0022565 | A1 | 1/2014 | Goto | |
| 2020/0285176 | A1 | 9/2020 | Sueoka | |
| 2022/0308505 | A1 * | 9/2022 | Kobayashi | G03G 15/5037 |
| 2022/0317608 | A1 * | 10/2022 | Minato | G03G 15/01 |
| 2022/0365465 | A1 * | 11/2022 | Hidaka | G03G 15/5041 |

FOREIGN PATENT DOCUMENTS

| | | | |
|---|---|---|---|
| EP | 1684497 | A2 | 7/2006 |
| JP | 2010-145606 | A | 7/2010 |
| JP | 2013037185 | A | 2/2013 |

(Continued)

*Primary Examiner* — Ryan D Walsh
(74) *Attorney, Agent, or Firm* — Canon U.S.A., Inc. I.P. Division

(57) ABSTRACT

An image forming apparatus that includes an image bearing member which can bear a toner image, a transfer member used to transfer a toner image onto a recording material from the image bearing member, and a reading device which reads density information of images on recording material disposed on a platen. The image forming apparatus forms a first chart on a first recording material and a second chart on a second recording material by sequentially transferring a plurality of test images while applying a plurality of test voltages to the transfer member. The two charts are read by the reading device and the transfer voltage is adjusted based on the reading result.

17 Claims, 18 Drawing Sheets

(56) References Cited

FOREIGN PATENT DOCUMENTS

| | | | |
|---|---|---|---|
| JP | 2017072689 | A | 4/2017 |
| JP | 2020086107 | A | 6/2020 |
| JP | 2020144289 | A | 9/2020 |
| JP | 2020184713 | A | 11/2020 |
| WO | 2019/054604 | A1 | 3/2019 |

* cited by examiner

FIG.5

| | | CONTAINED WATER AMOUNT OF AMBIENT ATMOSPHERE (g/kg) | | | | |
|---|---|---|---|---|---|---|
| | | 0.9 OR LESS | ··· | 8.9 | ··· | 21.5 OR MORE |
| PAPER GRAMMAGE ($g/m^2$) | • | • | | • | | • |
| | • | • | | • | | • |
| | 81 – 100 | 1000 V | ··· | 500 V | ··· | 200 V |
| | 101 – 125 | 1150 V | ··· | 600 V | ··· | 250 V |
| | 126 – 150 | 1300 V | ··· | 700 V | ··· | 300 V |
| | • | • | | • | | • |
| | • | • | | • | | • |

FIG.16

| COLOR | PAGE NUMBER | LARGE CHART | SMALL CHART |
|---|---|---|---|
| CYAN | 1 | ONE-SIDED CHART FIRST SURFACE OF TWO-SIDED CHART | ONE-SIDED CHART_FIRST CHART FIRST SURFACE OF TWO-SIDED CHART_FIRST CHART |
| MAGENTA | 2 | SECOND SURFACE OF TWO-SIDED CHART | ONE-SIDED CHART_SECOND CHART FIRST SURFACE OF TWO-SIDED CHART_SECOND CHART |
| YELLOW | 3 | — | SECOND SURFACE OF TWO-SIDED CHART_FIRST CHART |
| BLACK | 4 | — | SECOND SURFACE OF TWO-SIDED CHART_SECOND CHART |

READING ORDER
(a) INPUT IMAGE
(b) AFTER CORRECTION
1
2
-4
-3
-2
-1
0
1
2
3
4
5
1
2
3
4
5
-4
-3
-2
-1
0
1
2
3
4
5
-4
-3
-2
-1
0
1
2
3
4
5
-4
-3
-2
-1
0

IMAGE FORMING APPARATUS THAT CAN ENHANCE USABILITY BY REDUCING THE NUMBER OF TIMES A CHART IS PLACED ON A READING DEVICE

BACKGROUND OF THE DISCLOSURE

Field of the Disclosure

The present disclosure relates to an image forming apparatus such as a copier, a printer, or a facsimile apparatus that uses an electrophotographic system and an electrostatic recording system.

Description of the Related Art

Image forming apparatuses that use the electrophotographic system have conventionally included an intermediate transfer system image forming apparatus that primarily transfers a toner image formed on an image bearing member such as a photosensitive drum, onto an intermediate transfer member such as an intermediate transfer belt, and then secondarily transfers the toner image onto a recording material from the surface of the intermediate transfer member. The primary transfer is performed by applying a primary transfer voltage to a primary transfer portion at which the image bearing member and the intermediate transfer member contact. The secondary transfer is performed by applying a secondary transfer voltage to a secondary transfer portion at which the intermediate transfer member and a secondary transfer member contact, when a recording material passes through the secondary transfer portion.

For obtaining a high-quality image product, it is necessary to set an appropriate value as a secondary transfer voltage to be applied when a toner image on the intermediate transfer member is electrostatically and secondarily transferred onto the recording material. In a case where the secondary transfer voltage is not enough for a charge amount of toner on the intermediate transfer member, a desired image density sometimes fails to be obtained due to insufficient toner transfer onto the recording material. In a case where the secondary transfer voltage is too high, electric discharge occurs at the secondary transfer portion, and the charging polarity of toner on the intermediate transfer member is reversed by the electric discharge. This sometimes causes a "white spot" in which a toner image on the intermediate transfer member partially fails to be transferred.

A charge amount necessary for secondarily transferring toner on the intermediate transfer member onto a recording material variously fluctuates depending on the size of the recording material and an area ratio of a toner image. Thus, the secondary transfer voltage to be supplied to the secondary transfer portion is often applied as a constant voltage by outputting a fixed voltage corresponding to a predetermined current density. This is because, in this case, a transfer current corresponding to a predetermined voltage can be ensured in an important portion at which a toner image is to be transferred, irrespective of current flowing on the outside of the recording material or flowing in a portion on the recording material on which a toner image does not exist.

The secondary transfer voltage can be determined based on a transfer portion divided voltage corresponding to an electric resistance of the secondary transfer portion that has been detected in a preliminary rotation process executed before image formation, and a recording material divided voltage corresponding to the preset type of a recording material. With this configuration, an appropriate secondary transfer voltage can be set in accordance with an environmental variation, a usage history of a transfer member, and the type of the recording material. Nevertheless, because various types and states of recording materials are used for image formation, a preset default recording material divided voltage sometimes causes excess or deficiency in the secondary transfer voltage. In view of the foregoing, it is proposed that an image forming apparatus is provided with an adjustment mode in which a set voltage of a transfer voltage can be adjusted in accordance with a recording material to be actually used in image formation.

Japanese Patent Application Laid-Open No. 2013-37185 discusses an image forming apparatus including an adjustment mode for adjusting a set voltage of a secondary transfer voltage. In this adjustment mode, a chart including a plurality of patches (test images) formed on one recording material is output while a secondary transfer voltage is being switched for each patch. The chart is read by a reading device provided in the image forming apparatus, and the density of each patch is detected. Then, an optimum secondary transfer voltage condition is selected in accordance with the detection result.

In the case of using the above-described chart, the size of a chart desired to be formed in one adjustment sometimes becomes larger in consideration of the formation of a sufficient number of patches, the detection accuracy of the density of each patch, and the easiness of determination to be made by an operator. In addition, while only one chart is formed in the case of using a sheet with a large size such as an A3 size, two charts are sometimes formed in the case of using a recording material with a small size such as an A4 size or a letter (LTR) size.

In a case where two charts are formed, it has been conventionally necessary for an operator to switch a chart placed on the reading device, for each chart. Thus, for example, in a reading device of a pressing plate type, the operator needs to place a chart on the reading device twice. In a case where a two-sided adjustment chart including patches formed on both surfaces of a recording material is output, the operator needs to place a chart on the reading device four times. If the operator is required to perform an operation of placing a chart on the reading device, an increased number of times in this manner, usability might decline.

SUMMARY OF THE INVENTION

In view of the foregoing, aspects of the present disclosure provide an image forming apparatus that can enhance usability by reducing the number of times a chart is placed on a reading device.

According to the representative configuration of the present disclosure, an image forming apparatus includes an image bearing member configured to bear a toner image, a transfer member configured to transfer a toner image onto a recording material from the image bearing member, an application unit configured to apply a voltage to the transfer member, a discharge unit configured to discharge a recording material including an image formed by fixing a toner image transferred by the transfer member, a platen on which a recording material is disposed when an image on the recording material is to be read, a reading device configured to read density information of an image on a recording material disposed on the platen, and a control unit configured to execute an adjustment mode for adjusting a transfer voltage to be applied to the transfer member by the application unit in a transfer process, by discharging, from the discharge unit, a first recording material including a first chart formed by sequentially transferring a plurality of test images by applying a plurality of test voltages to the transfer member by the application unit, and a second recording material including a second chart formed by sequentially transferring a plurality of test images by applying a plurality of test voltages to the transfer member by the application unit, wherein the control unit is configured to adjust the transfer voltage based on a reading result obtained by the reading device reading the first recording material and the second recording material disposed together on the platen.

Further features of the present disclosure will become apparent from the following description of exemplary embodiments with reference to the attached drawings.

BRIEF DESCRIPTION OF THE DRAWINGS

FIG. 5 is a schematic diagram illustrating an example of a table of a recording material divided voltage.

FIG. 16 is a diagram illustrating a correspondence relationship between a color of a page determination patch and a page number.

DESCRIPTION OF THE EMBODIMENTS

Hereinafter, an image forming apparatus according to an exemplary embodiment of the present disclosure will be described in more detail with reference to the drawings.

1. Configuration and Operation of Image Forming Apparatus

Figure 1:
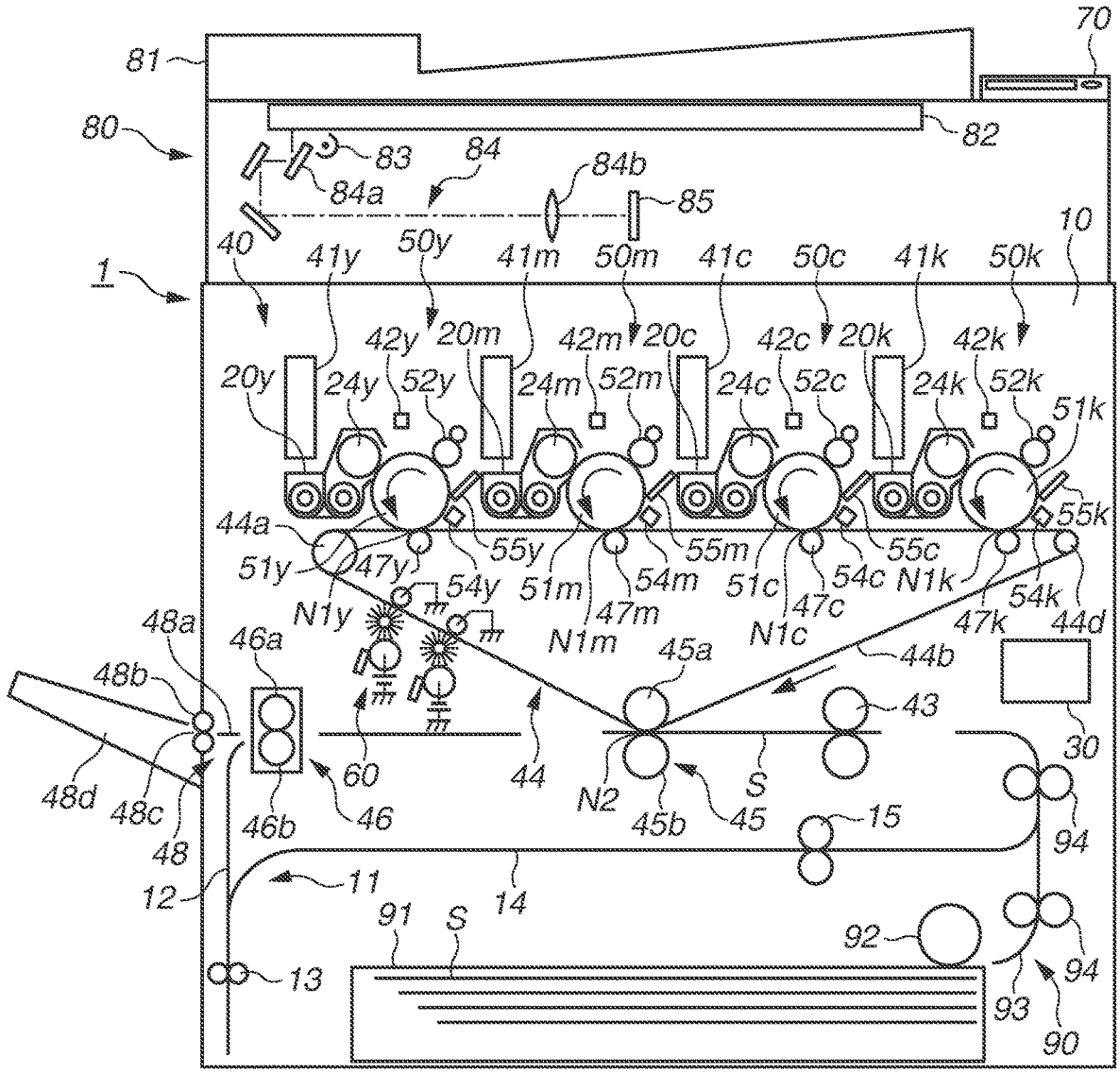
FIG. 1 is a schematic cross-sectional view of an image forming apparatus.

FIG. 1 is a schematic cross-sectional view of an image forming apparatus 1 according to a first exemplary embodiment. The image forming apparatus 1 according to the present exemplary embodiment is a tandem-type multifunction peripheral (including functions of a copier, a printer, and a facsimile apparatus) that employs an intermediate transfer system and can form a full-color image using an electrophotographic system.

Figure 2:
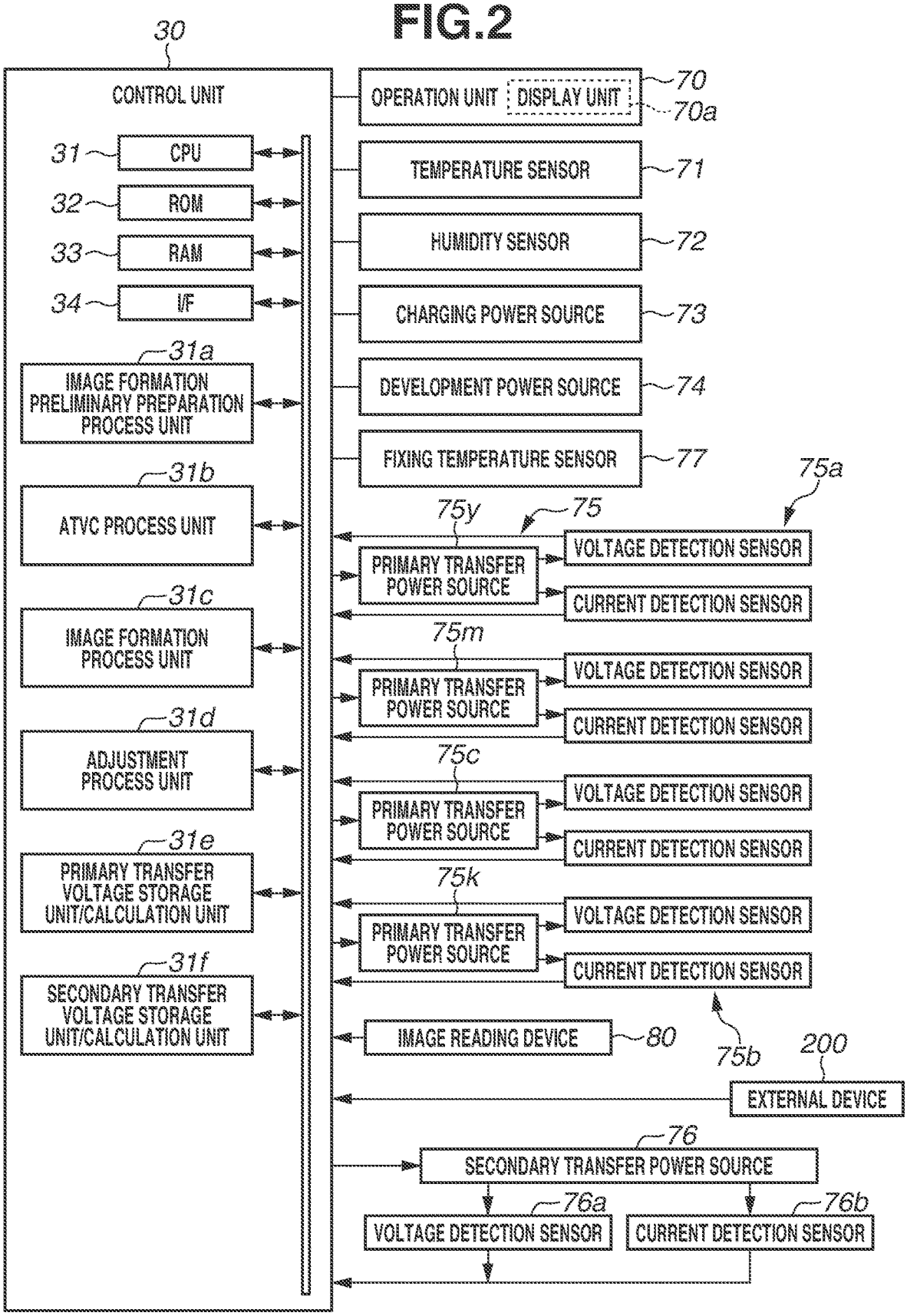
FIG. 2 is a block diagram illustrating a control system of an image forming apparatus.

As illustrated in FIG. 1, the image forming apparatus 1 includes an apparatus main body 10, an image reading device 80, a feeding unit 90, an image formation unit 40, a discharge unit 48, a control unit 30, and an operation unit 70. A temperature sensor 71 (FIG. 2) that can detect an internal temperature, and a humidity sensor 72 (FIG. 2) that can detect an internal humidity are provided inside the apparatus main body 10. The image forming apparatus 1 can form a full-color (four-color) image onto a recording material (sheet, transfer material, or recording medium) S in accordance with an image information (image signal) from the image reading device 80 or an external device (external apparatus) 200 (FIG. 2). Examples of the external device 200 include a host device such as a personal computer, a digital camera, and a smartphone. The recording material S is a recording material onto which a toner image is to be formed. Specific examples include plain paper, a synthetic resin sheet to be substituted for plain paper, thick paper, and an overhead projector sheet.

The image formation unit 40 can form an image onto the recording material S fed from the feeding unit (feeding device) 90, based on image information. The image formation unit 40 includes image forming units 50*y*, 50*m*, 50*c*, and 50*k*, toner bottles 41*y*, 41*m*, 41*c*, and 41*k*, exposure devices 42*y*, 42*m*, 42*c*, and 42*k*, an intermediate transfer unit 44, a secondary transfer device 45, and a fixing unit 46. The image forming units 50*y*, 50*m*, 50*c*, and 50*k* respectively form yellow (Y), magenta (M), cyan (C), and black (K) images. Components having the same or corresponding functions or configurations that are provided in association with these four image forming units 50*y*, 50*m*, 50*c*, and 50*k* will be sometimes collectively described omitting the letters y, m, c, and k added to the ends of the reference numerals for indicating the colors of the components. The image forming apparatus 1 can also form a monochrome image such as a black image, or a multicolored image using a desired single image forming unit 50 or several image forming units 50.

The image forming unit 50 includes the following components. First of all, the image forming unit 50 includes a photosensitive drum 51 being a drum-shaped (cylindrical) photosensitive member (electrophotographic photosensitive member) serving as an image bearing member. The image forming unit 50 further includes a charging roller 52 being a roller-shaped charging member serving as a charging unit. The image forming unit 50 further includes a development device 20 serving as a development unit. The image forming unit 50 further includes a preexposure device 54 serving as a charge removal unit. The image forming unit 50 further includes a drum cleaning device 55 serving as a photosensitive member cleaning unit. The image forming unit 50 forms a toner image onto an intermediate transfer belt 44*b* to be described below. The image forming units 50 are integrally formed as a process cartridge, and detachably attached to the apparatus main body 10.

The photosensitive drum 51 can move (rotate) while bearing an electrostatic image (electrostatic latent image) or a toner image. In the present exemplary embodiment, the photosensitive drum 51 is a negatively-charged organicphotoconductor (OPC) having an outer diameter of 30 mm. The photosensitive drum 51 includes an aluminum cylinder serving as a base member, and surface layers formed on the surface of the aluminum cylinder. In the present exemplary embodiment, the photosensitive drum 51 includes three layers as the surface layers. The three layers include an undercoat layer, a photocharge generation layer, and a charge transport layer that are applied and stacked in this order on the base member. If an image forming operation is started, the photosensitive drum 51 is rotationally driven by a motor (not illustrated) serving as a drive unit, in a direction (counterclockwise direction) indicated by an arrow in FIG. 1, at a predetermined process speed (circumferential speed).

The surface of the rotating photosensitive drum 51 is uniformly charged by the charging roller 52 to a predetermined potential of a predetermined polarity (negative polarity in the present exemplary embodiment). In the present exemplary embodiment, the charging roller 52 is a rubber roller that contacts the surface of the photosensitive drum 51 and that is driven to rotate in accordance with the rotation of the photosensitive drum 51. A charging power source 73 (FIG. 2) is connected to the charging roller 52. The charging power source 73 applies a predetermined charging voltage (charging bias) to the charging roller 52 in a charging process.

The charged surface of the photosensitive drum 51 is subjected to scanning exposure performed by the exposure device 42 based on image information, and an electrostatic image is formed on the photosensitive drum 51. In the present exemplary embodiment, the exposure device 42 is a laser scanner. The exposure device 42 emits laser light in accordance with image information of decomposition color output from the control unit 30, and performs scanning exposure of the surface (outer circumferential surface) of the photosensitive drum 51.

The electrostatic image formed on the photosensitive drum 51 is developed (visualized) by being supplied with toner by the development device 20, and a toner image is formed on the photosensitive drum 51. In the present exemplary embodiment, the development device 20 stores two-component developer containing nonmagnetic toner particles (toner) and magnetic carrier particles (carrier) as developer. Toner is supplied to the development device 20 from the toner bottle 41. The development device 20 includes a development sleeve 24. The development sleeve 24 is formed of a nonmagnetic material such as aluminum or nonmagnetic stainless (aluminum in the present exemplary embodiment). A magnet roller being a roller-shaped magnet is arranged inside the development sleeve 24 with being fixed in such a manner as not to rotate with respect to the main body (development container) of the development device 20. The development sleeve 24 bears developer and conveys the developer to a development region facing the photosensitive drum 51. A development power source 74 (FIG. 2) is connected to the development sleeve 24. The development power source 74 applies a predetermined development voltage (development bias) to the development sleeve 24 in a development process. In the present exemplary embodiment, toner charged to a polarity same (negative polarity in the present exemplary embodiment) as a charging polarity of the photosensitive drum 51 adheres to an exposed portion (image portion) on the photosensitive drum 51 of which an absolute value of a potential declines by being exposed after being uniformly charged (reverse development). In the present exemplary embodiment, a regular charging polarity of toner being a charging polarity of toner in development is a negative polarity.

The intermediate transfer unit 44 is arranged to face the four photosensitive drums 51*y*, 51*m*, 51*c*, and 51*k*. The intermediate transfer unit 44 includes the intermediate transfer belt 44*b* being an endless belt serving as an intermediate transfer member. The intermediate transfer belt 44*b* is stretched with predetermined tension by being winded around a drive roller 44*a*, a driven roller 44*d*, and a secondary transfer inner roller 45*a* that serve as a plurality of tension rollers (support rollers). The intermediate transfer belt 44*b* can move (rotate) while bearing a toner image. The drive roller 44*a* is rotationally driven by a motor (not illustrated) serving as a drive unit. The driven roller 44*d* is a tension roller that controls the tension of the intermediate transfer belt 44*b* to be constant. The driven roller 44*d* adds force for pushing the intermediate transfer belt 44*b* from the inner circumferential side to the outer circumferential side by an urging force of a tension spring (not illustrated) being a urging member serving as an urging unit. By the force, tension of about 2 to 5 kg is applied in a conveyance direction of the intermediate transfer belt 44*b*. The secondary transfer inner roller 45*a* constitutes the secondary transfer device 45 as described below. By the drive roller 44*a* being rotationally driven, a drive force is input to the intermediate transfer belt 44*b*, and the intermediate transfer belt 44*b* rotates (revolves) in a direction (clockwise direction) indicated by an arrow in FIG. 1, at a predetermined circumferential speed corresponding to the circumferential speed of the photosensitive drum 51. On the inner circumferential side of the intermediate transfer belt 44*b*, primary transfer rollers 47*y*, 47*m*, 47*c*, and 47*k* each being a roller-shaped primary transfer member serving as a primary transfer unit are arranged to face the respective photosensitive drums 51*y*, 51*m*, 51*c*, and 51*k*. The primary transfer roller 47 nips the intermediate transfer belt 44*b* with the photosensitive drum 51. The primary transfer roller 47 thereby contacts the photosensitive drum 51 via the intermediate transfer belt 44*b*, and a primary transfer portion (primary transfer nip) N1 at which the photosensitive drum 51 and the intermediate transfer belt 44*b* contact is formed.

The toner image formed on the photosensitive drum 51 is primarily transferred onto the rotating intermediate transfer belt 44*b* at the primary transfer portion N1. A primary transfer power source 75 (FIG. 2) is connected to the primary transfer roller 47. The primary transfer power source 75 applies a primary transfer voltage (primary transfer bias) being a direct-current voltage with a reverse polarity (positive polarity in the present exemplary embodiment) to a regular charging polarity of toner, to the primary transfer roller 47 in a primary transfer process. For example, when a full-color image is to be formed, yellow, magenta, cyan, and black toner images formed on the respective photosensitive drums 51*y*, 51*m*, 51*c*, and 51*k* are sequentially primarily transferred onto the intermediate transfer belt 44*b* in an overlapped manner A voltage detection sensor 75*a* (FIG. 2) that detects an output voltage, and a current detection sensor 75*b* (FIG. 2) that detects an output current are connected to the primary transfer power source 75 (FIG. 2). In the present exemplary embodiment, the primary transfer power sources 75*y*, 75*m*, 75*c*, and 75*k* (FIG. 2) are provided for the respective primary transfer rollers 47*y*, 47*m*, 47*c*, and 47*k*, and primary transfer voltages to be applied to the primary transfer rollers 47*y*, 47*m*, 47*c*, and 47*k* can be individually controlled.

In the present exemplary embodiment, the primary transfer roller 47 includes an elastic layer made of ionic conductive foamed rubber (nitrile rubber(NBR)), and a metal core. An outer diameter of the primary transfer roller 47 is 15 to 20 mm, for example. As the primary transfer roller 47, a roller having an electric resistance value of $1\times10^5$ to $1\times10^8\Omega$ (measured in N/N (23° C., 50% RH), 2 kV applied) can be desirably used. In the present exemplary embodiment, the intermediate transfer belt 44*b* is an endless belt having a three-layered structure including a base layer, an elastic layer, and a surface layer in this order from the inner circumferential side to the outer circumferential side. As the material of the base layer, a material obtained by mixing an appropriate amount of carbon black as antistat into resin such as polyimide or polycarbonate, or various types of rubber can be desirably used. The thickness of the base layer is 0.05 to 0.15 mm, for example. As an elastic material of the elastic layer, a material obtained by mixing an appropriate amount of an ionic conductor into various types of rubber such as urethane rubber or silicone rubber can be desirably used. The thickness of the elastic layer is 0.1 to 0.500 mm, for example. As the material of the surface layer, resin such as fluorine resin can be desirably used. The surface layer reduces toner adherence onto the surface of the intermediate transfer belt 44*b*, and causes toner to be easily transferred onto the recording material S at a secondary transfer portion N2 to be described below. The thickness of the surface layer is 0.0002 to 0.020 mm, for example. In the present exemplary embodiment, the surface layer uses, as a base material, a resin material of one type such as polyurethane, polyester, or epoxy resin, or materials of two or more types among elastic materials such as elastic rubber, elastomer, and butyl rubber. Then, the surface layer is formed by dispersing one type or two or more types of powder or particles of fluorine resin and the like, or the particles with varied particle dimeters, for example, in the base material as a material for reducing surface energy and increasing lubricity. In the present exemplary embodiment, the intermediate transfer belt 44*b* has a volume resistivity of $5\times10^8$ to $1\times10^{14}$ Ω·cm (23° C., 50% RH), and a hardness of 60 to 85° (23° C., 50% RH) measured by MD1. In the present exemplary embodiment, a static friction coefficient of the intermediate transfer belt 44*b* is 0.15 to 0.6 (23° C., 50% RH, measured by type94i manufactured by HEIDON). In the present exemplary embodiment, the intermediate transfer belt 44*b* has a three-layered structure. For example, the intermediate transfer belt 44*b* may have a single-layered structure including a material equivalent to the above-described material of the base layer, for example.

On the outer circumferential side of the intermediate transfer belt 44*b*, a secondary transfer outer roller 45*b* being a roller-shaped secondary transfer member serving as a secondary transfer unit that constitutes the secondary transfer device 45 together with the secondary transfer inner roller 45*a* is arranged. The secondary transfer outer roller 45*b* nips the intermediate transfer belt 44*b* with the secondary transfer inner roller 45*a*. The secondary transfer outer roller 45*b* thereby contacts the secondary transfer inner roller 45*a* via the intermediate transfer belt 44*b*, and the secondary transfer portion (secondary transfer nip) N2 at which the intermediate transfer belt 44*b* and the secondary transfer outer roller 45*b* contact is formed. At the secondary transfer portion N2, a toner image formed on the intermediate transfer belt 44*b* is secondarily transferred onto the recording material S conveyed with being nipped by the intermediate transfer belt 44*b* and the secondary transfer outer roller 45*b*. In the present exemplary embodiment, a secondary transfer voltage (secondary transfer bias) is applied to the secondary transfer outer roller 45*b* in a secondary transfer process.

In this manner, in the present exemplary embodiment, the secondary transfer device 45 includes the secondary transfer inner roller 45*a* serving as a counter member, and the secondary transfer outer roller 45*b* serving as a secondary transfer member. The secondary transfer inner roller 45*a* is arranged to face the secondary transfer outer roller 45*b* via the intermediate transfer belt 44*b*. A secondary transfer power source 76 (FIG. 2) serving as a voltage application unit (application unit) is connected to the secondary transfer outer roller 45*b*. The secondary transfer power source 76 applies a secondary transfer voltage (secondary transfer bias) being a direct-current voltage with a reverse polarity (positive polarity in the present exemplary embodiment) to a regular charging polarity of toner, to the secondary transfer outer roller 45*b* in a secondary transfer process. A voltage detection sensor 76*a* (FIG. 2) that detects an output voltage, and a current detection sensor 76*b* (FIG. 2) that detects an output current are connected to the secondary transfer power source 76 (FIG. 2). In the present exemplary embodiment, the metal core of the secondary transfer inner roller 45*a* is connected to a ground potential. In other words, in the present exemplary embodiment, the secondary transfer inner roller 45*a* is electrically grounded (connected to a ground). Then, when the recording material S is supplied to the secondary transfer portion N2, a secondary transfer voltage that is under constant voltage control and has a reverse polarity to a regular charging polarity of toner is applied to the secondary transfer outer roller 45*b*. In the present exemplary embodiment, for example, a secondary transfer voltage of 1 to 7 kV is applied, and a current of 40 to 120 μA flows, so that a toner image on the intermediate transfer belt 44*b* is secondarily transferred onto the recording material S. In the present exemplary embodiment, by the secondary transfer power source 76 applying a direct-current voltage to the secondary transfer outer roller 45*b*, a secondary transfer voltage is applied to the secondary transfer portion N2, but the present disclosure is not limited to this configuration. For example, by the secondary transfer power source 76 applying a direct-current voltage to the secondary transfer inner roller 45*a*, a secondary transfer voltage may be applied to the secondary transfer portion N2. In this case, a direct-current voltage with a polarity that is the same as a regular charging polarity of toner is applied to the secondary transfer inner roller 45*a* serving as a secondary transfer member, and the secondary transfer outer roller 45*b* serving as a counter member is electrically grounded. In the present exemplary embodiment, the secondary transfer outer roller 45*b* includes an elastic layer made of ionic conductive foamed rubber (NBR), and a metal core. An outer diameter of the secondary transfer outer roller 45*b* is 20 to 25 mm, for example. As the secondary transfer outer roller 45*b*, a roller having an electric resistance value of $1\times10^5$ to $1\times10^8\Omega$ (measured in N/N (23° C., 50% RH), 2 kV applied) can be desirably used.

Concurrently with the above-described toner image forming operation, the recording material S is fed from the feeding unit 90. More specifically, the recording materials S are stacked and stored in a recording material cassette 91 serving as a recording material storage unit. The recording material S stored in the recording material cassette 91 is fed to a conveyance path 93 by a feed roller 92 serving as a feeding member. The recording material S fed to the conveyance path 93 is conveyed to a registration roller pair 43 serving as a conveyance member, by a conveyance roller pair 94 serving as a conveyance member. The skew of the recording material S is corrected by the registration roller pair 43, and the recording material S is supplied to the secondary transfer portion N2 in synchronization with a toner image on the intermediate transfer belt 44*b*. The feeding unit 90 includes the recording material cassette 91, the feed roller 92, the conveyance path 93, and the conveyance roller pair 94.

The recording material S on which the toner image is transferred is conveyed to the fixing unit (fixing device) 46. The fixing unit 46 includes a fixing roller 46*a* and a pressure roller 46*b*. The fixing roller 46*a* includes a built-in heater serving as a heating unit. The recording material S bearing an unfixed toner image is conveyed with being nipped between the fixing roller 46*a* and the pressure roller 46*b*. Heat and pressure are thereby applied to the recording material S. The toner image is accordingly fixed (melt, bonded) onto the recording material S. A temperature (fixing temperature) of the fixing roller 46*a* is detected by a fixing temperature sensor 77 (FIG. 2).

The recording material S onto which the toner image is fixed is conveyed on a discharge path 48*a* by a discharge roller pair 48*b* serving as a conveyance member, discharged (output) from a discharge port 48*c*, and stacked on a discharge tray 48*d* provided on the outside of the apparatus main body 10. The discharge unit (discharge device) 48 includes the discharge path 48*a*, the discharge roller pair 48*b*, the discharge port 48*c*, and the discharge tray 48*d*. In the present exemplary embodiment, the image forming apparatus 1 can execute two-sided image formation (two-sided print, automatic two-sided printing) of forming images on both surfaces of the recording material S. A reversing conveyance path 12 for reversing the recording material S having the first surface on which a toner image has been fixed, and supplying the recording material S again to the secondary transfer portion N2 is provided between the fixing unit 46 and the discharge port 48*c*. In the two-sided image formation, the recording material S having the first surface on which a toner image has been fixed is guided to the reversing conveyance path 12. The conveyance direction of the recording material S is reversed by a switchback roller pair 13 provided on the reversing conveyance path 12, and the recording material S is guided to a two-sided conveyance path 14. Then, the recording material S is fed to the conveyance path 93 by a re-conveyance roller pair 15 provided on the two-sided conveyance path 14, conveyed up to the registration roller pair 43, and supplied to the secondary transfer portion N2 by the registration roller pair 43. After that, a toner image is secondarily transferred onto the second surface of the recording material S similarly to the toner image formed on the first surface. After the transferred toner image is fixed, the recording material S is discharged to the discharge tray 48*d*. A two-sided conveyance unit (two-sided conveyance device) 11 includes the reversing conveyance path 12, the switchback roller pair 13, the two-sided conveyance path 14, and the re-conveyance roller pair 15. By the operation of the two-sided conveyance unit 11, images can be formed on both surfaces of one recording material S.

The charge on the surface of the photosensitive drum 51 having been subjected to primary transfer is removed by the preexposure device 54. An adherent such as toner (primary transfer residual toner) remaining on the photosensitive drum 51 without being transferred onto the intermediate transfer belt 44*b* in the primary transfer process is removed from the surface of the photosensitive drum 51 and collected by the drum cleaning device 55. The drum cleaning device 55 scrapes off the adherent from the surface of the rotating photosensitive drum 51 using a cleaning blade serving as a cleaning member that contacts the surface of the photosensitive drum 51, and stores the adherent into a cleaning container. The cleaning blade is brought into contact with the surface of the photosensitive drum 51 by predetermined pressing force in such a manner that its leading end on a free end side is oriented in a counter direction for facing an upstream side in the rotation direction of the photosensitive drum 51. The intermediate transfer unit 44 includes a belt cleaning device 60 serving as an intermediate transfer member cleaning unit. An adherent such as toner (secondary transfer residual toner) remaining on the intermediate transfer belt 44*b* without being transferred onto the recording material S in the secondary transfer process is removed from the surface of the intermediate transfer belt 44*b* and collected by the belt cleaning device 60.

The image reading device 80 serving as a reading unit (reading unit) is arranged in an upper part of the apparatus main body 10. The image reading device 80 includes an automatic document conveyance device (automatic document feeder (ADF)) 81 serving as a document conveyance unit (document conveyance unit), a platen glass 82, an optical system 84 including a light source 83, mirrors 84*a*, and an image forming lens 84*b*, and a reading element 85 such as a charge-coupled device (CCD) image sensor.

In the present exemplary embodiment, the image reading device 80 can sequentially read images on a document (the recording material S on which images are formed) arranged on the platen glass 82, by the reading element 85 via the optical system 84 while performing scanning exposure using the movable light source 83. In this case, the image reading device 80 sequentially illuminates documents arranged on the platen glass 82, with light from the moving light source 83, and sequentially forms optical images onto the reading element 85 via the optical system 84 based on reflected light from the documents. The reading element 85 can thereby read the images on the documents at a predefined dot density. The platen glass 82 forms a reading surface supporting the recording material S in such a manner that the image reading device 80 can read the recording material S.

In the present exemplary embodiment, the image reading device 80 can sequentially read images on documents conveyed by the automatic document conveyance device 81, by the reading element 85 via the optical system 84 by sequentially exposing the documents using the light source 83 in accordance with the conveyance of the documents. In this case, the image reading device 80 sequentially illuminates documents passing through a predetermined reading position on the platen glass 82, with light from the light source 83, and sequentially forms optical images onto the reading element 85 via the optical system 84 based on reflected light from the documents. The reading element 85 can thereby read the images on the documents at a predefined dot density. The automatic document conveyance device 81 automatically conveys documents one by one in a separated state in such a manner as to cause the documents to pass through the above-described reading position of the image reading device 80. The automatic document conveyance device 81 forms a conveyance device that sequentially conveys the recording materials S in such a manner that the image reading device 80 can read the recording materials S.

In this manner, the image reading device 80 optically reads an image on the recording material S placed on the platen glass 82 or conveyed by the automatic document conveyance device 81, and converts the read image into an electric signal.

In the present exemplary embodiment, the image reading device 80 can arrange, on the platen glass 82, one recording material S having a large size such as an A3 size, or two recording materials S having a small size such as an A4 size, side by side. In the present exemplary embodiment, the image reading device 80 can continuously convey a plurality of recording materials S having an A3 size or an A4 size, for example, that is stacked on a document stacking portion of the automatic document conveyance device 81, to the above-described reading position. The automatic document conveyance device 81 can automatically read images on both surfaces of the recording material S.

For example, in a case where the image forming apparatus 1 operates as a copier, an image on a document read by the image reading device 80 is transmitted to an image processing unit of the control unit 30 as three-color image data corresponding to red (R), green (G), blue (B) (8 bits for each color), for example. In the image processing unit, predetermined image processing is executed as necessary on the image data of the document, and the image data is converted into image data of four colors including yellow, magenta, cyan, and black. Examples of the above-described image processing include shading correction, positional shift correction, brightness/color space conversion, gamma correction, frame deletion, and color/moving edition. Image data corresponding to four colors including yellow, magenta, cyan, and black are sequentially transmitted to the respective exposure devices 42*y*, 42*m*, 42*c*, and 42*k*, and the above-described image exposure is performed in accordance with the image data. The image reading device 80 is also used for reading patches on a chart (acquiring density information (luminance information)) in an adjustment mode as described in detail below.

FIG. 2 is a block diagram schematically illustrating a configuration of a control system of the image forming apparatus 1 according to the present exemplary embodiment. As illustrated in FIG. 2, the control unit 30 is formed by a computer. The control unit 30 includes, for example, a central processing unit (CPU) 31 serving as a calculation control unit, a read-only memory (ROM) 32 serving as a storage unit and storing a program for controlling each component, a random access memory (RAM) 33 serving as a storage unit and temporarily storing data, and an input-output circuit (interface (I/F)) 34 that inputs and outputs a signal from and to the outside. The CPU 31 is a microprocessor that governs the entire control of the image forming apparatus 1, and predominantly constitutes a system controller. Via the input-output circuit 34, the CPU 31 is connected to the feeding unit 90, the image formation unit 40, the discharge unit 48, and the operation unit 70, and exchanges signals with these components and controls operations of these components. The ROM 32 stores an image formation control sequence for forming an image onto the recording material S. The charging power source 73, the development power source 74, the primary transfer power source 75, and the secondary transfer power source 76 are connected to the control unit 30, and these components are controlled in accordance with signals from the control unit 30. The temperature sensor 71, the humidity sensor 72, the voltage detection sensor 75*a* and the current detection sensor 75*b* of the primary transfer power source 75, the voltage detection sensor 76*a* and the current detection sensor 76*b* of the secondary transfer power source 76, and the fixing temperature sensor 77 are also connected to the control unit 30. A signal detected by each sensor is input to the control unit 30.

The operation unit 70 includes an input unit such as an operation button that serves as an input unit, and a display unit 70*a* including a liquid crystal panel that serves as a display unit. In the present exemplary embodiment, the display unit 70*a* is formed as a touch panel, and also has a function as an input unit. By operating the operation unit 70, an operator such as a user or a service staff can execute a job (to be described below). The control unit 30 operates various devices of the image forming apparatus 1 upon receiving signals from the operation unit 70. The image forming apparatus 1 can also execute a job based on an image formation signal (image data, control command) from the external device 200 such as a personal computer.

In the present exemplary embodiment, the control unit 30 includes an image formation preliminary preparation process unit 31*a*, an active transfer voltage control (ATVC) process unit 31*b*, an image formation process unit 31*c*, and an adjustment process unit 31*d*. The control unit 30 further includes a primary transfer voltage storage unit/calculation unit 31*e* and a secondary transfer voltage storage unit/calculation unit 31*f*. These process units and the storage unit/calculation units may be provided as a part of the CPU 31 or the RAM 33. For example, the control unit 30 (more specifically, the image formation process unit 31*c*) can execute a job as described above. In addition, the control unit 30 (more specifically, the ATVC process unit 31*b*) can execute ATVC (setting mode) of a primary transfer portion and a secondary transfer portion. The ATVC will be described in detail below. In addition, the control unit 30 (more specifically, the adjustment process unit 31*d*) can execute an adjustment mode for adjusting a set voltage of a secondary transfer voltage. The adjustment mode will be described in detail below.

The image forming apparatus 1 executes a job (image output operation, print job) being a series of operations of forming images onto one or a plurality of recording materials S and outputting the recording materials S that is started in accordance with one start instruction. A job generally includes an image forming process, a preliminary rotation process, a sheet-to-sheet interval process in the case of forming images onto a plurality of recording materials S, and a post rotation process. The image forming process corresponds to a period for forming an electrostatic image, forming a toner image, and performing primary transfer and secondary transfer of the toner image, of an image to actually be output by being formed on the recording material S. An image forming state (image forming period) refers to this period. More specifically, the timing of the image forming state varies depending on the positions at which these processes including the formation of an electrostatic image, the formation of a toner image, and the primary transfer and secondary transfer of the toner image are performed. The preliminary rotation process corresponds to a period for performing a preparation operation prior to the image forming process, and corresponds to a period from the input of a start instruction until an image actually starts to be formed. The sheet-to-sheet interval process corresponds to a period corresponding to an interval between the recording material S and the recording material S in continuously performing image formation onto a plurality of recording materials S (continuous image formation). The post rotation process corresponds to a period for performing an arrangement operation (preparation operation) subsequent to the image forming process. A non-image forming state (non-image forming period) corresponds to a period other than the image forming state, and includes the above-described preliminary rotation process, the sheet-to-sheet interval process, and the post rotation process. The non-image forming state further includes a preliminary multiple rotation process being a preparation operation to be performed when the power of the image forming apparatus 1 is turned on or when the image forming apparatus 1 recovers from a sleep state.

2. Control of Secondary Transfer Voltage

Figure 3:
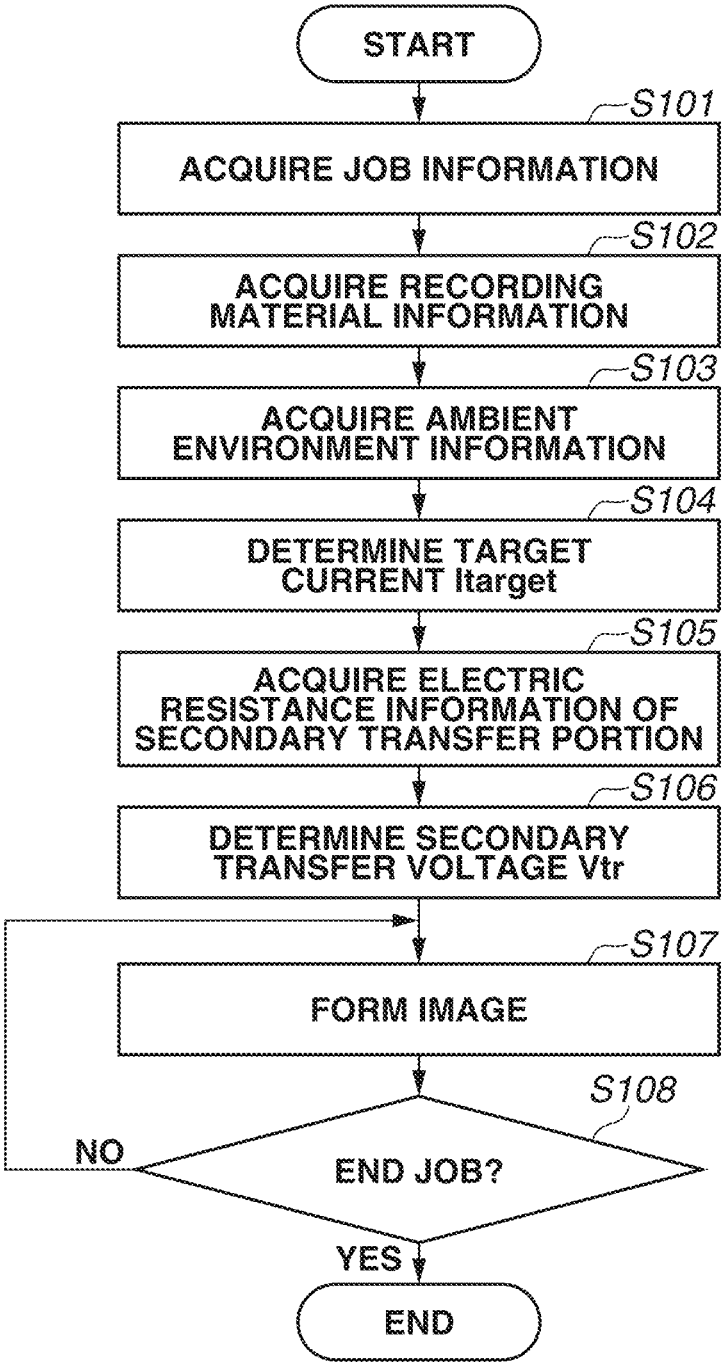
FIG. 3 is a flowchart schematically illustrating a control procedure of a secondary transfer voltage.

Next, control of a secondary transfer voltage will be described. FIG. 3 is a flowchart schematically illustrating a procedure of control of a secondary transfer voltage according to the present exemplary embodiment. The control of a secondary transfer voltage generally includes constant voltage control and constant current control. In the present exemplary embodiment, constant voltage control is used.

First of all, in step S101, the control unit 30 (the image formation preliminary preparation process unit 31*a*) starts an operation of a job upon acquiring job information from the operation unit 70 or the external device 200. The job information includes image information designated by an operator, and information regarding the recording material S. The information regarding the recording material S may include a size (width, length) of the recording material S on which an image is to be formed, information (thickness, grammage, etc.) related to the thickness of the recording material S, and information related to a surface property of the recording material S such as information indicating whether the recording material S is coated paper. Especially in the present exemplary embodiment, the information regarding the recording material S includes information regarding the size of the recording material S, and information regarding a category (so-called paper type category) of the recording material S such as "thin paper, plain paper, thick paper, and so on" that is related to the thickness of the recording material S. The information regarding the recording material S (recording material information) encompasses arbitrary information that can identify the recording material S, such as an attribute (so-called paper type category) that is based on general features, including plain paper, high-quality paper, glazed paper, gloss paper, coated paper, embossed paper, thick paper, and thin paper, a numerical value or a numerical value range of grammage, thickness, size, and rigidity, or brand (including a manufacturer, product name, product number). The recording materials S can be classified by a type identified based on the information regarding the recording material S. The information regarding the recording material S may be included in information regarding a print mode designating an operation setting of the image forming apparatus 1, such as "plain paper mode" and "thick paper mode", or may be substituted by information regarding a print mode. In step S102, the control unit 30 writes the job information into the RAM 33.

Next, in step S103, the control unit 30 acquires environment information detected by the temperature sensor 71 and the humidity sensor 72. The ROM 32 stores information indicating a correlative relationship between environment information and a target current Itarget for transferring a toner image on the intermediate transfer belt 44*b* onto the recording material S. Based on the environment information read in step S103, the control unit 30 (the secondary transfer voltage storage unit/calculation unit 31*f*) obtains a target current Itarget suitable for the environment from the above-described information indicating a relationship between the environment information and the target current Itarget. Then, in step S104, the control unit 30 writes the target current Itarget into the RAM 33 (or the secondary transfer voltage storage unit/calculation unit 31*f*). The target current Itarget is changed in accordance with the environment information because a charge amount of toner varies depending on the environment.

The above-described information indicating a relationship between the environment information and the target current Itarget is information preliminarily obtained by an experiment.

Figure 4:
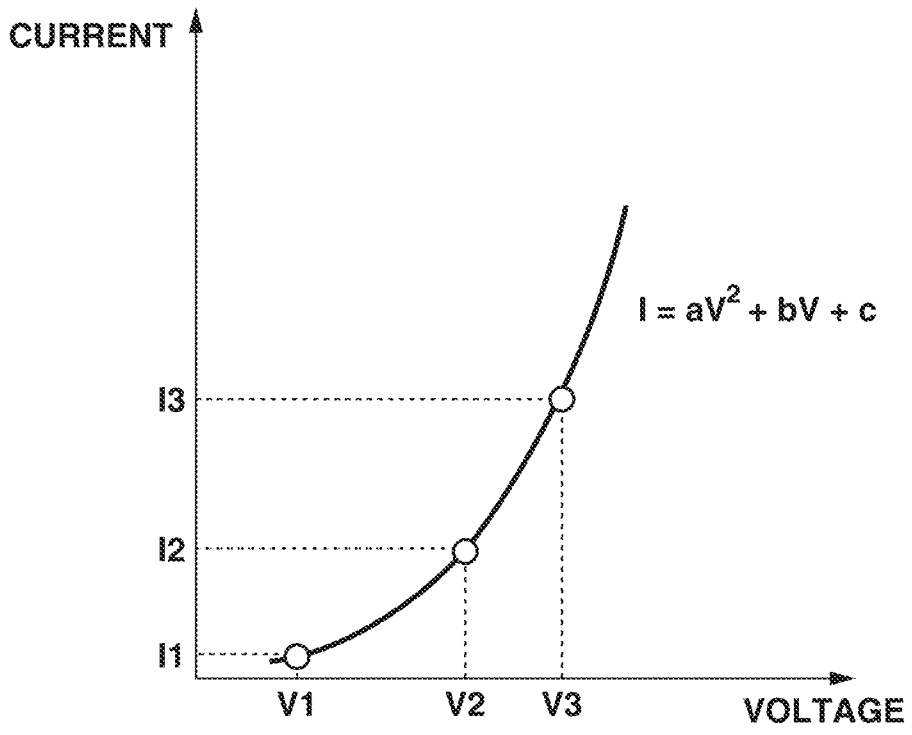
FIG. 4 illustrates a graph indicating voltage and current characteristics acquired by control of a secondary transfer voltage.

Next, in step S105, the control unit 30 (the ATVC process unit 31*b*) acquires information regarding an electric resistance of the secondary transfer portion N2 by ATVC before a toner image on the intermediate transfer belt 44*b*, and the recording material S onto which a toner image is to be transferred reach the secondary transfer portion N2. In other words, in a state in which the secondary transfer outer roller 45*b* and the intermediate transfer belt 44*b* are brought into contact, predetermined voltages at a plurality of levels are supplied from the secondary transfer power source 76 to the secondary transfer outer roller 45*b*. Then, by the current detection sensor 76*b* detecting current values obtained when the predetermined voltages are supplied, a relationship between voltage and current (voltage and current characteristics) as illustrated in FIG. 4 is acquired. The control unit 30 writes the information indicating a relationship between voltage and current, into the RAM 33 (or the secondary transfer voltage storage unit/calculation unit 31*f*). The relationship between voltage and current changes in accordance with an electric resistance of the secondary transfer portion N2. In the above-described relationship between voltage and current in the configuration according to the present exemplary embodiment, current changes as represented by a second-order or higher-order polynomial expression (quadratic expression in the present exemplary embodiment) of voltage without changing linearly with respect to (being proportional to) voltage. Thus, in the present exemplary embodiment, when information regarding an electric resistance of the secondary transfer portion N2 is acquired, three or more levels of predetermined voltages or currents are supplied in such a manner that the above-described relationship between voltage and current can be represented by a polynomial expression.

Next, in step S106, the control unit 30 (the secondary transfer voltage storage unit/calculation unit 31*f*) obtains a value of a voltage to be applied to the secondary transfer outer roller 45*b* from the secondary transfer power source 76. In other words, based on the target current Itarget written into the RAM 33 in step S104, and the relationship between voltage and current that has been obtained in step S105, the control unit 30 obtains a value of a voltage Vb necessary for flowing the target current Itarget in a state in which the recording material S does not exist at the secondary transfer portion N2. The voltage Vb corresponds to a secondary transfer portion divided voltage (transfer voltage corresponding to an electric resistance of the secondary transfer portion N2). As illustrated in FIG. 5, the ROM 32 stores information for obtaining a recording material divided voltage (transfer voltage corresponding to an electric resistance of the recording material S) Vp. In the present exemplary embodiment, the information is set as table data indicating a relationship between a water amount of atmosphere and the recording material divided voltage Vp for each group of grammages of the recording material S (corresponding to paper type category). The control unit 30 can obtain a water amount of atmosphere based on the environment information (temperature and humidity) detected by the temperature sensor 71 and the humidity sensor 72. The control unit 30 (the secondary transfer voltage storage unit/calculation unit 31*f*) obtains the recording material divided voltage Vp from the above-described table data based on the job information acquired in step S101, and the environment information acquired in step S103. In a case where an adjustment value is set by an adjustment mode for adjusting a set voltage of a secondary transfer voltage, which will be described below, the control unit 30 (the secondary transfer voltage storage unit/calculation unit 31*f*) obtains an adjustment amount ΔV in accordance with the adjustment value. As described below, in a case where the adjustment amount ΔV is set by the adjustment mode, the adjustment amount ΔV is stored in the RAM 33 (or the secondary transfer voltage storage unit/calculation unit 31*f*). The control unit 30 obtains a value Vb+Vp+ΔV by adding the above-described voltages Vb and Vp, and the adjustment amount ΔV, as a secondary transfer voltage Vtr to be applied to the secondary transfer outer roller 45*b* from the secondary transfer power source 76 when the recording material S passes through the secondary transfer portion N2. Then, the control unit 30 writes the secondary transfer voltage Vtr (=Vb+Vp+ΔV) into the RAM 33 (or the secondary transfer voltage storage unit/calculation unit 31*f*). The table data for obtaining the recording material divided voltage Vp that is illustrated in FIG. 5 is data preliminarily obtained by an experiment.

In some cases, the recording material divided voltage Vp also changes in accordance with the surface property of the recording material S aside from information (thickness, grammage, etc.) related to the thickness of the recording material S. Thus, the above-described table data may be set in such a manner that the recording material divided voltage Vp also changes in accordance with information related to the surface property of the recording material S. In the present exemplary embodiment, information related to the thickness of the recording material S (furthermore, information related to the surface property of the recording material S) is included in the job information acquired in step S101. Nevertheless, the image forming apparatus 1 may be provided with a measurement unit that detects a thickness of the recording material S or a surface property of the recording material S, and the recording material divided voltage Vp may be obtained based on information obtained by the measurement unit.

Next, in step S107, the control unit 30 (the image formation process unit 31*c*) causes image formation to be executed, and causes secondary transfer to be performed by feeding the recording material S to the secondary transfer portion N2 and applying the secondary transfer voltage Vtr determined as described above. After that, in step S108, the control unit 30 (the image formation process unit 31*c*) repeats the processing in step S107 until all the images of the job are transferred onto the recording material S and the output ends.

ATVC similar to the above-described control is performed on the primary transfer portion N1 during a period from the start of the job until a toner image is conveyed to the primary transfer portion N1, but the detailed description will be omitted.

3. Overview of Adjustment Mode

Next, an adjustment mode (simple adjustment mode) for adjusting a set voltage of a secondary transfer voltage will be described.

Depending on the type or the state of the recording material S to be used in image formation, a water amount or an electric resistance value of the recording material S sometimes differ significantly from that of a standard recording material S. In this case, optimum transfer sometimes fails to be performed by a set voltage of a secondary transfer voltage that is set using a preset default recording material divided voltage Vp as described above. In other words, the secondary transfer voltage is to be initially set to a voltage required for transferring toner on the intermediate transfer belt 44*b* onto the recording material S. In addition, the secondary transfer voltage is to be suppressed to a voltage at which abnormal electric discharge does not occur. Nevertheless, depending on the type or the state of the recording material S to be actually used in image formation, an electric resistance is sometimes higher than a value expected as a standard value. In this case, a set voltage of a secondary transfer voltage that is set using the preset default recording material divided voltage Vp sometimes becomes insufficient as a voltage required for transferring toner on the intermediate transfer belt 44*b* onto the recording material S. Thus, in this case, it is demanded to increase a set voltage of a secondary transfer voltage by increasing the recording material divided voltage Vp. In contrast, depending on the type or the state of the recording material S to be actually used in image formation, an electric resistance is sometimes lower than a value expected as a standard value due to an increased water amount of the recording material S, and electric discharge sometimes easily occurs. In this case, a set voltage of a secondary transfer voltage that is set using the preset default recording material divided voltage Vp sometimes causes an image defect due to abnormal electric discharge. Thus, in this case, it is demanded to decrease a set voltage of a secondary transfer voltage by decreasing the recording material divided voltage Vp.

Thus, an operator such as a user or a service staff is sometimes demanded to adjust (change) a set voltage of a secondary transfer voltage in job execution to an optimum value by adjusting (changing) the recording material divided voltage Vp in accordance with the recording material S to be actually used in image formation. In other words, it is sometimes demanded to select an optimum recording material divided voltage Vp+ΔV (adjustment amount) suitable for the recording material S to be actually used in image formation. The adjustment is also considered to be performed by the following method.

More specifically, for example, the method is a method of determining a set voltage of an optimum secondary transfer voltage (more specifically, the recording material divided voltage Vp+ΔV) by an operator outputting images desired to be output, while switching a secondary transfer voltage for one recording material S, and checking the output images. Nevertheless, in this method, because image output and adjustment of a set voltage of a secondary transfer voltage are repeated, in some cases, the number of wasted recording materials S increases, and the adjustment takes time.

In view of the foregoing, the image forming apparatus 1 according to the present exemplary embodiment includes an adjustment mode for adjusting a set voltage of a secondary transfer voltage. In this adjustment mode, the image forming apparatus 1 outputs a chart including a plurality of patches (test images) in representative colors that is formed on the recording material S to be actually used in image formation, while switching a set voltage of a secondary transfer voltage for each patch. Then, based on a reading result of the output chart that is obtained by the image reading device 80, a set voltage of an optimum secondary transfer voltage (more specifically, the recording material divided voltage Vp+ΔV) can be determined. In the present exemplary embodiment, in the adjustment mode, information regarding a recommended adjustment amount ΔV of a set voltage of a secondary transfer voltage is presented based on density information (luminance information) of a patch (typically, solid image patch) on the chart. With this configuration, it becomes possible to adjust the setting of a secondary transfer voltage more suitably while reducing operation burden on the operator by reducing the necessity of the operator visually checking images on the chart.

4. Chart

Next, a chart (adjustment image, test page) to be output in the adjustment mode according to the present exemplary embodiment will be described. FIGS. 6A and 6B, and FIGS. 7A, 7B, 7C, and 7D are schematic diagrams of a chart 100 according to the present exemplary embodiment.

Figure 6A:
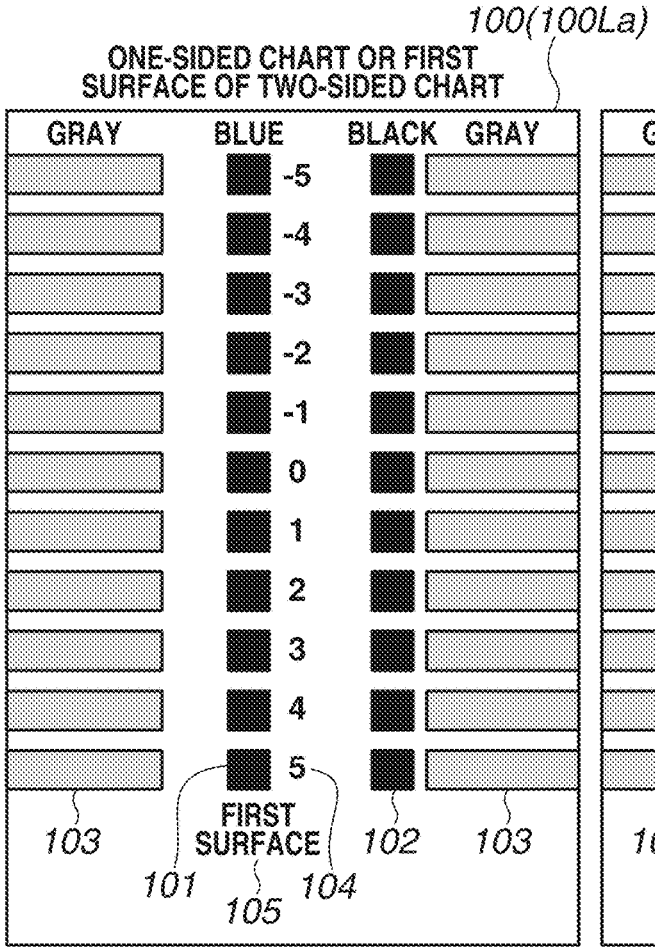
FIGS. 6A and 6B are schematic diagrams of a chart for a large-sized recording material.
Figure 6B:
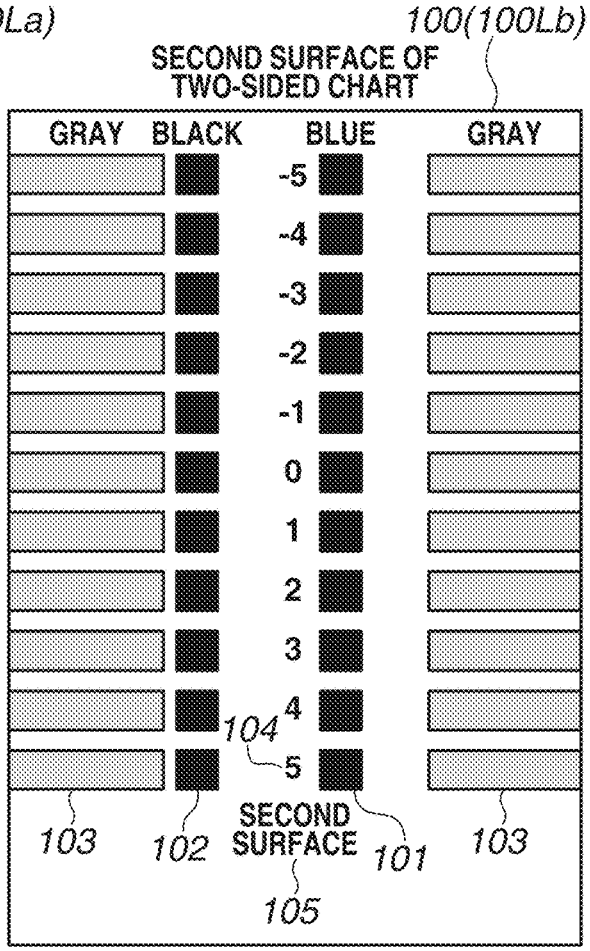

In the present exemplary embodiment, charts are broadly divided into two types of charts 100 illustrated in FIGS. 6A and 6B, and FIGS. 7A, 7B, 7C, and 7D, and in the adjustment mode, the two types of charts 100 are output in accordance with the size of the recording material S to be used. FIGS. 6A and 6B illustrate the chart 100 to be output in a case where a length in the conveyance direction of the recording material S is 420 to 487 mm FIGS. 7A, 7B, 7C, and 7D illustrate the chart 100 to be output in a case where a length in the conveyance direction of the recording material S is 210 to 419 mm. In the present exemplary embodiment, charts can be output onto both surfaces of the recording material S also in the adjustment mode in such a manner that secondary transfer voltages to be applied in secondary transfer onto the front surface (the first surface) and the rear surface (the second surface) in two-sided image formation can be individually adjusted. FIGS. 6A and 6B, and FIGS. 7A, 7B, 7C, and 7D illustrate a chart (hereinafter, will also be referred to as a "one-sided chart") to be formed on one surface of the recording material S, and a chart (hereinafter, will also be referred to as a "two-sided chart") to be formed on both surfaces of the recording material S. The two-sided chart is formed by two-sided image formation using the above-described two-sided conveyance unit 11.

The size of the recording material S is indicated by a recording material width (main scanning direction length)×a recording material length (sub scanning direction length). The recording material width is a length in a direction (width direction) substantially orthogonal to the conveyance direction of the recording material S in passing through the secondary transfer portion N2. The recording material length is a length in a direction substantially parallel to the conveyance direction of the recording material S in passing through the secondary transfer portion N2.

FIGS. 6A and 6B illustrate charts (hereinafter, will also be referred to as "large charts") 100L (100La and 100Lb) for large-sized recording materials that are to be output in a case where the recording material S having a large size such as an A3 size (297 mm×420 mm) or Ledger (about 280 mm×432 mm) is used. FIG. 6A illustrates the large chart 100La output as a one-sided chart, or output as the first surface of a two-sided chart. FIG. 6B illustrates the large chart 100Lb output as the second surface of a two-sided chart.

Figure 7A:
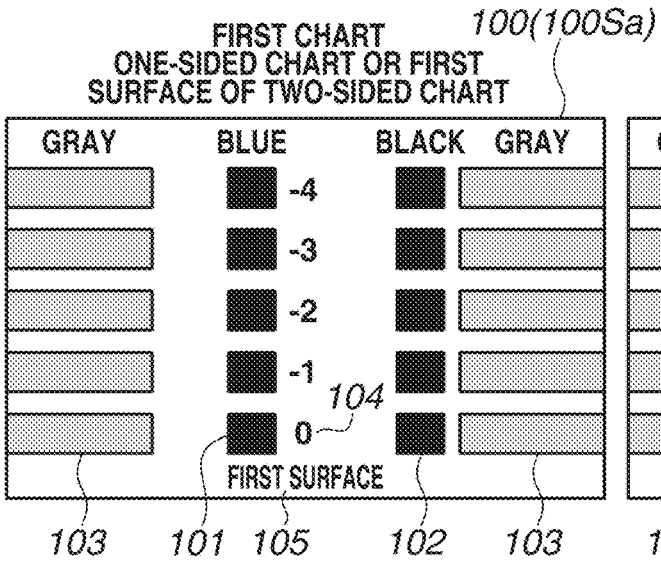
FIGS. 7A, 7B, 7C, and 7D are schematic diagrams of a chart for a small-sized recording material.
Figure 7C:
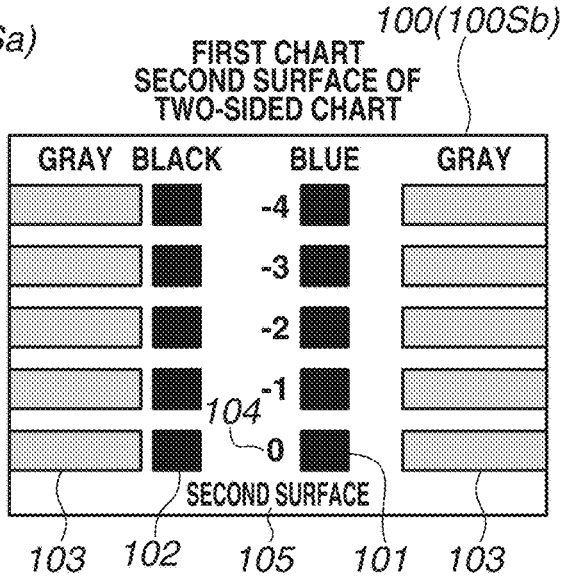
Figure 7B:
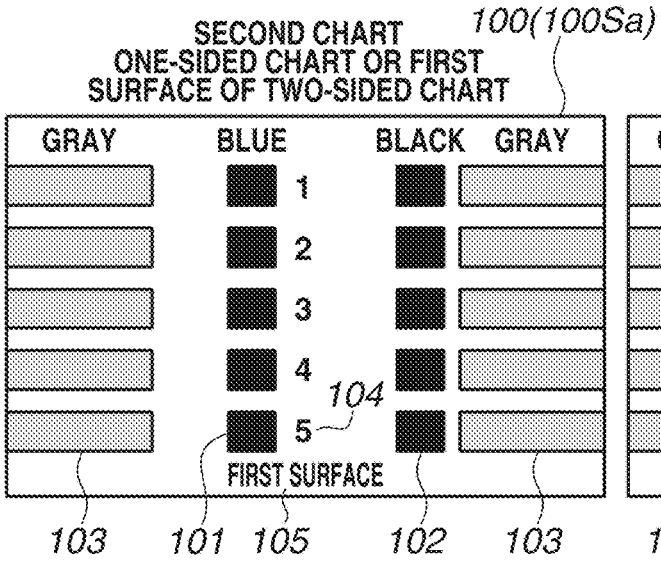
Figure 7D:
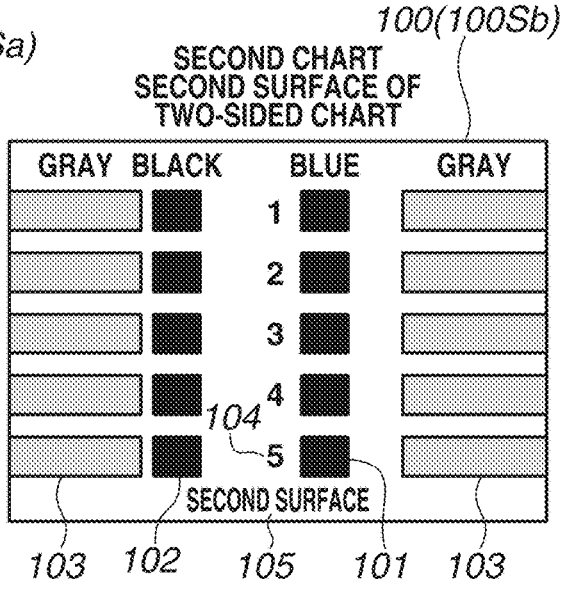

FIGS. 7A, 7B, 7C, and 7D illustrate charts (hereinafter, will also be referred to as "small charts") 100S (100Sa and 100Sb) for small-sized recording materials that are to be output in a case where the recording material S having a small size such as A4 landscape (297 mm×210 mm) or letter landscape (about 280 mm×216 mm) is used. FIGS. 7A and 7B respectively illustrate the small chart 100Sa output as the first one-sided chart or the first surface of the first two-sided chart, and the small chart 100Sa output as the second one-sided chart or the first surface of the second two-sided chart. FIGS. 7C and 7D respectively illustrate the small chart 100Sb output as the second surface of the first two-sided chart, and the small chart 100Sb output as the second surface of the second two-sided chart.

In consideration of visual check to be performed by an operator, if the size of patches on a chart to be output in the adjustment mode becomes larger, it becomes easier to check an image defect, which is advantageous. Nevertheless, if the size of patches is large, the number of patches that can be formed on one recording material S decreases. A square shape can be employed as the shape of patches. The colors of patches can be determined depending on an image defect desired to be checked and the easiness of check. For example, in a case where a secondary transfer voltage is increased from a low value, a lower limit value of a secondary transfer voltage can be determined based on a voltage value at which patches in secondary colors such as red, green, and blue can be appropriately transferred. In a case where the operator visually checks patches, in a case where a secondary transfer voltage is further increased, an upper limit value of a secondary transfer voltage can be determined based on a voltage value at which an image defect occurs in halftone patches due to a high secondary transfer voltage.

The chart 100 includes patch sets each including one blue solid patch 101, one black solid patch 102, and two halftone patches 103 arrayed side by side in a width direction. In the large charts 100L in FIGS. 6A and 6B, eleven patch sets each including the width-direction-arrayed patches 101 to 103 are arrayed in the conveyance direction. In the large charts 100S in FIGS. 7A, 7B, 7C, and 7D, ten patch sets each including the width-direction-arrayed patches 101 to 103 are arrayed in the conveyance direction. In the present exemplary embodiment, the halftone patches 103 are gray (black halftone) patches. Solid images are images having the highest density level. In the present exemplary embodiment, a blue solid image is obtained by an overlap of magenta (M) toner=100% and cyan (C) toner=100%, and a toner application amount of the blue solid image is 200%. A black solid image is an image of black (K) toner=100%. A halftone image is an image with a toner application amount of 10 to 80% when a toner application amount of a solid image is 100%, for example. In the present exemplary embodiment, in the chart 100, patch identification information 104 for identifying the setting of a secondary transfer voltage applied to each patch set is provided in association with a corresponding set of the patches 101 to 103. The patch identification information 104 may be a value corresponding to an adjustment value of a secondary transfer voltage to be described below. In the large charts 100L illustrated in FIGS. 6A and 6B, eleven pieces (in the present exemplary embodiment, eleven pieces corresponding to −5 to 0 to +5) of patch identification information 104 corresponding to the settings of eleven levels of secondary transfer voltages are arranged. In the small charts 100S illustrated in FIGS. 7A, 7B, 7C, and 7D, ten pieces (in the present exemplary embodiment, five pieces corresponding to −4 to 0 on the first chart, and five pieces corresponding to +1 to +5 on the second chart) of patch identification information 104 corresponding to the settings of ten levels of secondary transfer voltages are arranged. In the charts 100, front/rear identification information 105 indicating at least one of the front surface (the first surface) or the rear surface (the second surface) of the recording material S may be provided on at least one of the front surface (the first surface) or the rear surface (the second surface) of the recording material S.

The patches desirably have sizes that enable the operator to easily determine the existence or non-existence of an image defect. If the sizes of patches are small, it tends to become difficult to determine the transferability of the blue solid patch 101 and the black solid patch 102. Thus, the size of patches is desirably set to a size equal to or larger than a size of 10 mm×10 mm, and more desirably set to a size equal to or larger than a size of 25 mm×25 mm.

An image defect caused in the halftone patch 103 by electric discharge that occurs in a case where a secondary transfer voltage is increased often becomes an image defect like a white spot. The image defect tends to be easily determined even in a small image as compared with the transferability of a solid image. Nevertheless, it is better to avoid too small images for facilitating visualization. Thus, in the present exemplary embodiment, a width in the conveyance direction of the halftone patch 103 is set to a width which is the same as the widths in the conveyance direction of the blue solid patch 101 and the black solid patch 102. An interval between patch sets each including patches 101 to 103 that are arrayed in the conveyance direction is only required to be set in such a manner that a secondary transfer voltage can be switched. In the present exemplary embodiment, the blue solid patches 101 and the black solid patches 102 are squares (one side is substantially parallel to the width direction) each having a size of 25.7 mm×25.7 mm. In the present exemplary embodiment, the halftone patches 103 at both ends in the width direction each have a width in the conveyance direction of 25.7 mm, and extend up to the ends of the chart 100 in the width direction. In the present exemplary embodiment, an interval in the conveyance direction between patch sets each including the patches 101 to 103 is set to 9.5 mm. At a timing at which a portion on the chart 100 that corresponds to the interval passes through the secondary transfer portion N2, a secondary transfer voltage is switched. In the present exemplary embodiment, patch sets each including the patches 101 to 103 that are formed on the chart 100 are sequentially transferred from the upstream side toward the downstream side in the conveyance direction of the recording material S in forming the chart 100, using a plurality of secondary transfer voltages (test voltages) varied to have sequentially increasing absolute values. Nevertheless, the present disclosure is not limited to this configuration. The patch sets each including the patches 101 to 103 that are formed on the chart 100 may be sequentially transferred from the upstream side toward the downstream side in the conveyance direction of the recording material S in forming the chart 100, using a plurality of secondary transfer voltages (test voltages) varied to have sequentially decreasing absolute values.

It is desirable that no patch is formed near the leading end and the posterior end in the conveyance direction of the recording material S (for example, a range of about 20 to 30 mm inward from the edge end) for the following reason. More specifically, out of the ends in the conveyance direction of the recording material S, an image defect sometimes occurs only at the leading end or the posterior end in the conveyance direction, without occurring at the ends in the width direction. In this case, it sometimes becomes difficult to determine whether an image defect has occurred due to an allocated secondary transfer voltage.

The largest size of the recording material S that can be used in the image forming apparatus 1 according to the present exemplary embodiment is a size of 13 inches (about 330 mm)×19.2 inches (about 487 mm). The large charts 100L illustrated in FIGS. 6A and 6B correspond to the recording material S having the largest size. In a case where the size of the recording material S is equal to or smaller than the size of 13 inches×19.2 inches, and equal to or larger than the A3 size (297 mm×420 mm), a chart corresponding to image data extracted from image data of the large chart 100L illustrated in FIG. 6A or 6B, in accordance with the size of the recording material S is output. At this time, in the present exemplary embodiment, image data is extracted in accordance with the size of the recording material S with reference to the leading end center. More specifically, image data is extracted in a state in which the leading end in the conveyance direction of the recording material S and the leading end (upper end in FIGS. 6A and 6B) in the conveyance direction of the large chart 100L are aligned, and the center in the width direction of the recording material S and the center in the width direction of the large chart 100L are aligned. In the present exemplary embodiment, image data is extracted in such a manner that margins of 2.5 mm are provided at the ends (in the present exemplary embodiment, both ends in the width direction and both ends in the conveyance direction). For example, in a case where the large chart 100L is output onto the recording material S having the A3 size (297 mm×420 mm), image data corresponding to the range of 292 mm×415 mm is extracted while providing a margin of 2.5 mm at each end. Then, the large chart 100L corresponding to the image data is output onto the recording material S having the A3 size (297 mm×420 mm), with respect to the leading end center. In a case where the recording material S with a width smaller than 13 inches is used, the size in the width direction of the halftone patches 103 at the ends in the width direction becomes smaller. In a case where the recording material S with a length smaller than 19.2 inches is used, a margin at a posterior end in the conveyance direction becomes smaller. As described above, eleven patch sets corresponding to −5 to 0 to +5 are arranged on the large chart 100L. On the large chart 100L, the eleven patch sets each including the patches 101 to 103 are arranged within the range with a length in the conveyance direction of 387 mm in such a manner as to fall within a length in the conveyance direction of 415 mm that is set in a case where the size of the recording material S is the A3 size.

In the present exemplary embodiment, in a case where the recording material S with a size smaller than the A3 size (297 mm×420 mm) is used, the small charts 100S illustrated in FIGS. 7A, 7B, 7C, and 7D are output. The small charts 100S illustrated in FIGS. 7A, 7B, 7C, and 7D correspond to a size from an A5 size (vertical feed) to a size smaller than the A3 size (297 mm×420 mm) (i.e., length of 210 to 419 mm in the conveyance direction). As described above, ten patch sets in total including five sets corresponding to −4 to 0 on the first chart, and five sets corresponding to +1 to +5 on the second chart are arranged on the small chart 100S. The size of image data of the small chart 100S is 13 inches×210 mm. The size in the width direction is adjusted by reducing the size of the halftone patches 103 in the width direction in accordance with the size of the recording material S. The size in the conveyance direction is set in such a manner that five patch sets fall within a length in the conveyance direction of 167 mm, and a margin at the posterior end becomes longer in accordance with the length of 210 to 419 mm in the conveyance direction of the recording material S. In a case where a length in the conveyance direction of the recording material S is 210 to 419 mm, only five patch sets can be formed in the conveyance direction on one chart. Thus, for increasing the number of patches, ten patch sets in total including five sets corresponding to −4 to 0 and five sets corresponding to +1 to +5 are formed on two separate charts. On the small chart 100S, a patch set corresponding to −5 on the large chart 100L is omitted.

In addition, irrespective of the size of the recording material S, the blue solid patches 101 and the black solid patches 102 on the front surface (the first surface) and the rear surface (the second surface) of the two-sided chart are arranged in such a manner as not to overlap each other on the front and rear surfaces of the recording material S. In the present exemplary embodiment, a patch interval in the width direction is set to 5.4 mm. This is for suppressing a variation in detection result of patch density on the second surface due to the influence of patch density on the first surface, and for more accurately adjusting a secondary transfer voltage on the second surface.

In the present exemplary embodiment, aside from standardized sizes, the chart 100 can be output using a recording material S with an arbitrary size (free size) by the operator designating a size by inputting the size from the operation unit 70 or the external device 200, for example.

5. Operation in Adjustment Mode

Figure 8:
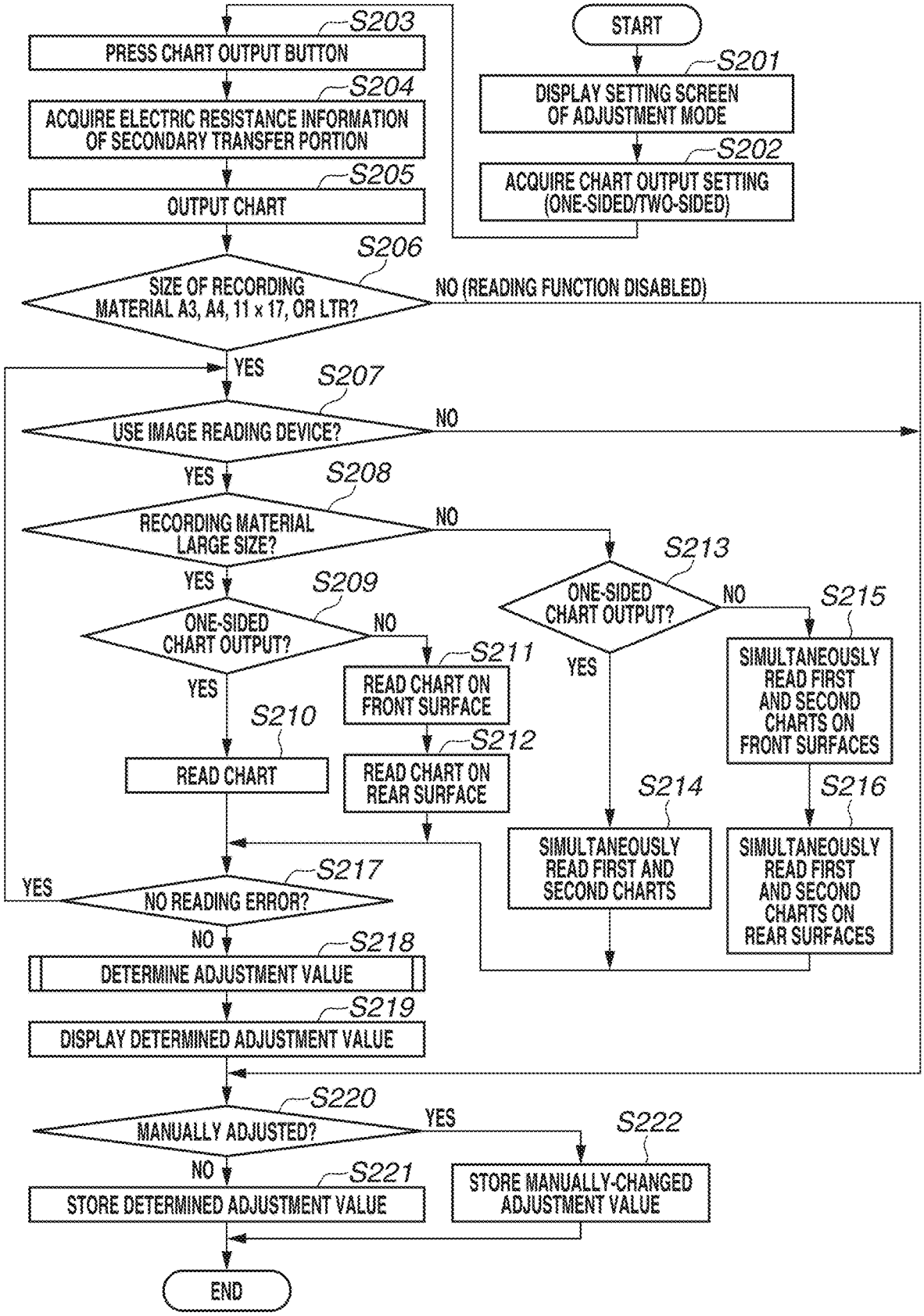
FIG. 8 is a flowchart illustrating a procedure of an adjustment mode according to a first exemplary embodiment.
Figure 9A:
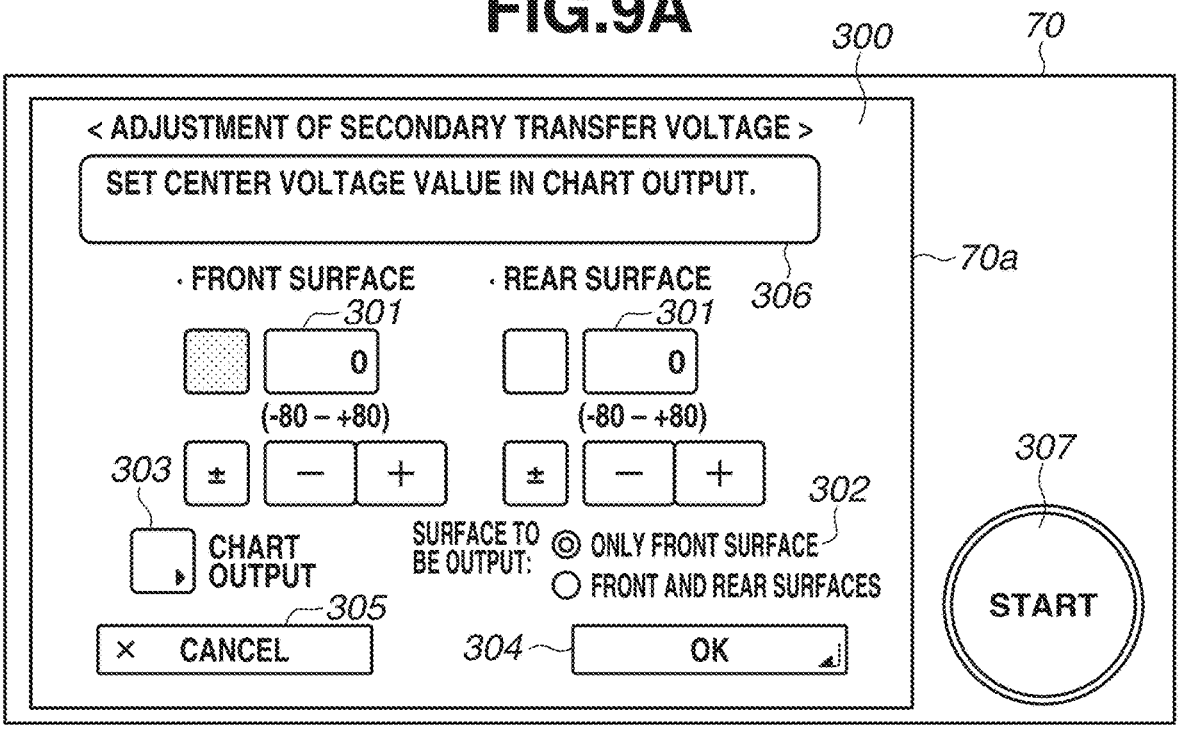
FIGS. 9A, 9B, and 9C are schematic diagrams of a setting screen of an adjustment mode.
Figure 9B:
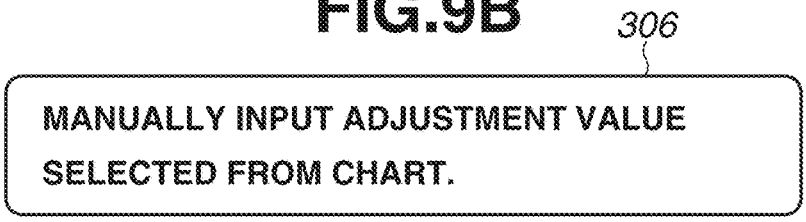
Figure 9C:
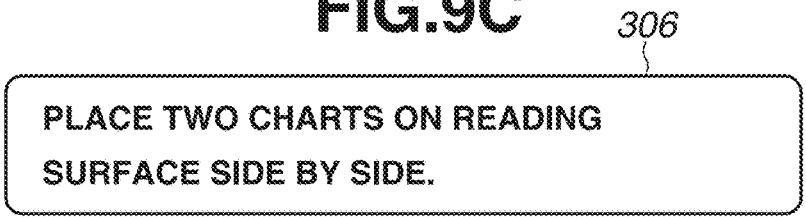

Next, an operation in the adjustment mode according to the present exemplary embodiment will be described. FIG. 8 is a flowchart schematically illustrating a procedure in the adjustment mode according to the present exemplary embodiment. FIGS. 9A, 9B, and 9C are schematic diagrams illustrating an example of a setting screen of an adjustment mode. The description will be given of an example case where an operator executes the adjustment mode by inputting an instruction from the operation unit 70 of the image forming apparatus 1. The description will be given of an example case where density information (luminance information) of a patch is read in a state in which the recording material S including the formed chart 100 is placed by the operator on the platen glass 82 (original platen glass) of the image reading device 80. For the sake of simplicity, a recording material on which a chart is formed will be sometimes simply referred to as a "chart".

A setting screen of an adjustment mode will be described. In the present exemplary embodiment, the control unit 30 (the adjustment process unit 31*d*) displays a setting screen 300 of an adjustment mode as illustrated in FIG. 9A, on the display unit 70*a* of the operation unit 70. The setting screen 300 includes a voltage setting unit 301 for setting an adjustment value of a secondary transfer voltage for the front surface (the first surface) and the rear surface (the second surface) of the recording material S. The setting screen 300 further includes an output surface selection unit 302 for selecting whether to output the chart 100 onto one surface or both surfaces of the recording material S. The setting screen 300 further includes an output instruction unit (chart output button) 303 for issuing an output instruction of the chart 100. The setting screen 300 further includes a determination unit (OK button) 304 for determining the setting, and a cancel button 305 for cancelling the change of the setting. The setting screen 300 further includes a message display unit 306 for displaying various messages regarding the adjustment mode. In the present exemplary embodiment, a start button 307 provided in the operation unit 70 adjacently to the display unit 70*a* functions as an input unit for inputting a reading start instruction of the chart 100 to the image reading device 80. Alternatively, a display (button) functioning as the input unit may be provided on the above-described setting screen 300 displayed on the display unit 70*a*.

In a case where an adjustment value of "0" is selected in the voltage setting unit 301, a secondary transfer voltage (more specifically, the recording material divided voltage Vp) is set to a specified value (table value) preset for the currently-selected recording material S. In this case, the secondary transfer voltage may be set to a value currently-set for the currently-selected recording material S. In this case, a center voltage value (value corresponding to the patch set of 0 on the chart 100) of secondary transfer voltages in outputting the chart 100 is set to the value. In a case where an adjustment value other than "0" is selected, in the present exemplary embodiment, the secondary transfer voltage is adjusted by an adjustment amount ΔV of 150 V for each level of an adjustment value. In this case, a center voltage value of secondary transfer voltages in outputting the chart 100 is set to the value. By the chart output button 303 being operated after an adjustment value is selected, the chart 100 is output with the selected center voltage value. By the OK button 304 being operated after an adjustment value is selected, the adjustment value of a secondary transfer voltage is determined. The control unit 30 acquires information regarding a setting such as a center voltage value that has been input in the operation unit 70 via the setting screen 300, and stores the information into a storage unit (the RAM 33, the secondary transfer voltage storage unit/calculation unit 31*f*, etc.) as necessary.

A procedure in the adjustment mode will be described. First of all, if information (paper type category, size, etc.) regarding the recording material S to be used in the adjustment mode is input by the operator, in step S201, the control unit 30 displays the setting screen 300 of the adjustment mode on the display unit 70*a*.

At this time, the control unit 30 displays the setting screen 300 on the display unit 70*a*. The control unit 30 acquires the information regarding the recording material S that has been input by the operator on the input screen, and adjusts a secondary transfer voltage in association with the information regarding the recording material S. The information regarding the recording material S may be acquired in the following manner. If the recording material cassette 91 storing the recording material S to be used in the adjustment mode is selected, information preset in association with the recording material cassette 91 may be acquired.

Next, in step S202, the control unit 30 acquires a setting of a center voltage value of secondary transfer voltages in outputting the chart 100, and a setting indicating whether to output a one-sided chart or a two-sided chart, which have been input by the operator on the setting screen 300. Next, in step S203, the control unit 30 acquires a signal indicating that the operator has operated the chart output button 303 on the setting screen 300. After that, in step S204, the control unit 30 acquires a second-order or higher-order polynomial expression (quadratic expression in the present exemplary embodiment) of a relationship between voltage and current that corresponds to an electric resistance of the secondary transfer portion N2, by an operation similar to the above-described ATVC, precedential to the output of the chart 100. Then, in step S205, the control unit 30 sets a secondary transfer voltage (test voltage) based on the acquired information regarding the relationship between voltage and current, and information regarding the center voltage value set on the setting screen 300, and performs control to output the chart 100. At this time, the control unit 30 performs control to output a predetermined chart 100 suitable for the size of the recording material S, by adjusting image data of the chart 100 as described above, and changing a secondary transfer voltage every 150 V. As described above, in a case where the recording material S corresponding to the large chart 100L is used, one large chart 100L obtained by transferring eleven patch sets onto the recording material S while switching a secondary transfer voltage, and fixing the patch sets is output. As described above, in a case where the recording material S corresponding to the small chart 100S is used, the two small charts 100S each obtained by transferring five patch sets onto the recording material S while switching a secondary transfer voltage, and fixing the patch sets are output.

Next, in step S206, the control unit 30 determines whether the image reading device 80 can read the chart 100, based on whether the size of the recording material S used for outputting the chart 100 is a size readable by the image reading device 80. In a case where the control unit 30 determines in step S206 that reading cannot be executed (NO in step S206), the processing proceeds to step S220. At this time, the control unit 30 can display a message for prompting the operator to manually adjust a secondary transfer voltage, in the message display unit 306 (FIG. 9A) of the setting screen 300 as illustrated in FIG. 9B, for example. In a case where the size of the recording material S used for outputting the chart 100 is a size unreadable by the image reading device 80, in step S220, a secondary transfer voltage can be manually adjusted by inputting an adjustment value in the voltage setting unit 301 (FIG. 9A) of the setting screen 300. In a case where the control unit 30 determines in step S206 that reading is executable (YES in step S206), the processing proceeds to step S207. Then, in step S207, the control unit 30 waits for a reading start instruction of the chart 100 to be input by the operator operating the start button 307 in the operation unit 70. At this time, the control unit 30 can display a message for prompting the operator to set the charts 100 on the image reading device 80, in the message display unit 306 (FIG. 9A) of the setting screen 300 as illustrated in FIG. 9C, for example. FIG. 9C illustrates an example case where the small charts 100S are output. In a case where the size of the recording material S is a size readable by the image reading device 80, in step S219, the control unit 30 can present a candidate of a desirable setting of a secondary transfer voltage based on a reading result of the chart 100 that is obtained by the image reading device 80. In a case where an adjustment value of a secondary transfer voltage is manually changed on the setting screen 300 while waiting for a reading start instruction of the chart 100 to be input, the control unit 30 advances the processing to step S220.

Next, in step S207, if the control unit 30 acquires a reading start signal for issuing a reading start instruction of the chart 100, from the operation unit 70, the processing proceeds to step S208. In step S208, the control unit 30 determines whether the size of the recording material S used for outputting the chart 100 is a large size. In a case where the control unit 30 determines in step S208 that the size of the recording material S is a large size such as the A3 size (297 mm×420 mm) or Ledger (about 280 mm×432 mm) (YES in step S208), the processing proceeds to step S209. Then, in step S209, the control unit 30 determines whether a one-sided chart has been output or a two-sided chart has been output. In a case where the control unit 30 determines in step S209 that a one-sided chart has been output (YES in step S209), the processing proceeds to step S210. In step S210, only one surface of the recording material S is read by the image reading device 80. In a case where the control unit 30 determines in step S209 that a two-sided chart has been output (NO in step S209), the processing proceeds to step S211. In step S211, first of all, the front surface (the first surface) of the recording material S is read by the image reading device 80. After that, if the control unit 30 acquires a reading start signal again from the operation unit 70, in step S212, the rear surface (the second surface) of the recording material S is read. In this manner, in a case where the recording material S with a large size is used, one large chart 100L on which eleven patch sets corresponding to −5 to 0 to +5 are formed, which has been set on the image reading device 80 is read in accordance with one reading start signal.

On the other hand, in a case where the control unit 30 determines in step S208 that the size of the recording material S is a small size such as A4 landscape (297 mm×210 mm) or letter landscape (about 280 mm×216 mm), the processing proceeds to step S213. Then, in step S213, the control unit 30 determines whether a one-sided chart has been output or a two-sided chart has been output. In a case where the control unit 30 determines in step S213 that a one-sided chart has been output (YES in step S213), the processing proceeds to step S214. In step S214, only one surfaces of two recording materials S are simultaneously read by the image reading device 80. In a case where the control unit 30 determines in step S213 that a two-sided chart has been output (NO in step S213), the processing proceeds to step S215. In step S215, first of all, the front surfaces (the first surfaces) of the two recording materials S are simultaneously read by the image reading device 80. After that, if the control unit 30 acquires a reading start signal again from the operation unit 70, in step S216, the rear surfaces (the second surfaces) of the two recording materials S are simultaneously read. In this manner, in a case where the recording material S with a small size is used, the first small chart 100S on which five patch sets corresponding to −4 to 0 are formed, and the second small chart 100S on which five patch sets corresponding to +1 to +5 are formed, which have been simultaneously set on the image reading device 80 are read in accordance with one reading start signal. In the present exemplary embodiment, the above-described one reading start signal is input to the control unit 30 by the operator operating the start button 307 serving as an input unit. Nevertheless, the present disclosure is not limited to this configuration. For example, the image reading device 80 can include a sensor detecting that a document is arranged on the reading surface, or detecting that a document is placed on the document stacking portion of the automatic document conveyance device 81, and automatically start the reading of the document in accordance with a detection result obtained by the sensor. In the case of such a configuration, the above-described one reading start signal may be input to the control unit 30 from the above-described sensor serving as an input unit.

Next, in step S217, the control unit 30 determines a reading error for determining whether the chart 100 has failed to be properly read by the image reading device 80. The description is given of an example case where the chart 100 placed on the platen glass 82 is read. Alternatively, for example, a reading error can be determined in a case where any trouble occurs in the conveyance of the chart 100 that is performed by the automatic document conveyance device 81. In a case where the control unit 30 determines in step S217 that no reading error has been detected (NO in step S217), the processing proceeds to step S218. In step S218, the control unit 30 performs processing of determining an adjustment value of a secondary transfer voltage. The processing of determining an adjustment value of a secondary transfer voltage will be described below. On the other hand, in a case where the control unit 30 determines in step S217 that a reading error has detected (YES in step S217), the processing returns to step S207, and the control unit 30 determines again whether to use the image reading device 80.

Next, in step S219, the control unit 30 displays the adjustment value determined in step S218, in the voltage setting unit 301 of the setting screen 300. The adjustment value indicates a candidate of a desirable setting of a secondary transfer voltage. By visually checking the chart 100, the operator can determine whether the adjustment value displayed on the setting screen 300 is suitable. In a case where the operator does not change the adjustment value displayed on the setting screen 300, the operator operates the OK button 304 on the setting screen 300 without making any change. On the other hand, in a case where the operator changes (manually adjusts) the adjustment value displayed on the setting screen 300, the operator inputs an adjustment value desired to be set, into the voltage setting unit 301 of the setting screen 300, and operates the OK button 304 on the setting screen 300. In step S220, the control unit 30 determines whether the adjustment value has been changed. Then, in a case where the control unit 30 acquires a signal indicating that the OK button 304 has been operated without the adjustment value being changed (NO in step S220), the processing proceeds to step S221. In step S221, the control unit 30 stores the adjustment value determined in step S218, into the RAM 33 (or the secondary transfer voltage storage unit/calculation unit 31*f*). On the other hand, in a case where the control unit 30 acquires a signal indicating that the OK button 304 has been operated after the adjustment value has been changed (YES in step S220), the processing proceeds to step S222. In step S222, the control unit 30 stores the adjustment value input by the operator, into the RAM 33 (or the secondary transfer voltage storage unit/calculation unit 31*f*). In the above-described manner, the adjustment mode ends.

When executing a subsequent job using the recording material S for which a secondary transfer voltage has been set in the adjustment mode, the control unit 30 (the secondary transfer voltage storage unit/calculation unit 31*f*) sets a secondary transfer voltage in accordance with the adjustment value stored as described above, until the next adjustment mode is executed. More specifically, the control unit 30 (the secondary transfer voltage storage unit/calculation unit 31*f*) calculates an adjustment amount ΔV as ΔV=adjustment value×150 V using the adjustment value stored as described above, and calculates an adjusted recording material divided voltage Vp+ΔV using the calculated adjustment amount ΔV. Then, using the adjusted recording material divided voltage Vp+ΔV, the control unit 30 (the secondary transfer voltage storage unit/calculation unit 31*f*) calculates a secondary transfer voltage Vtr (=Vb+Vp+ΔV).

Figure 10:
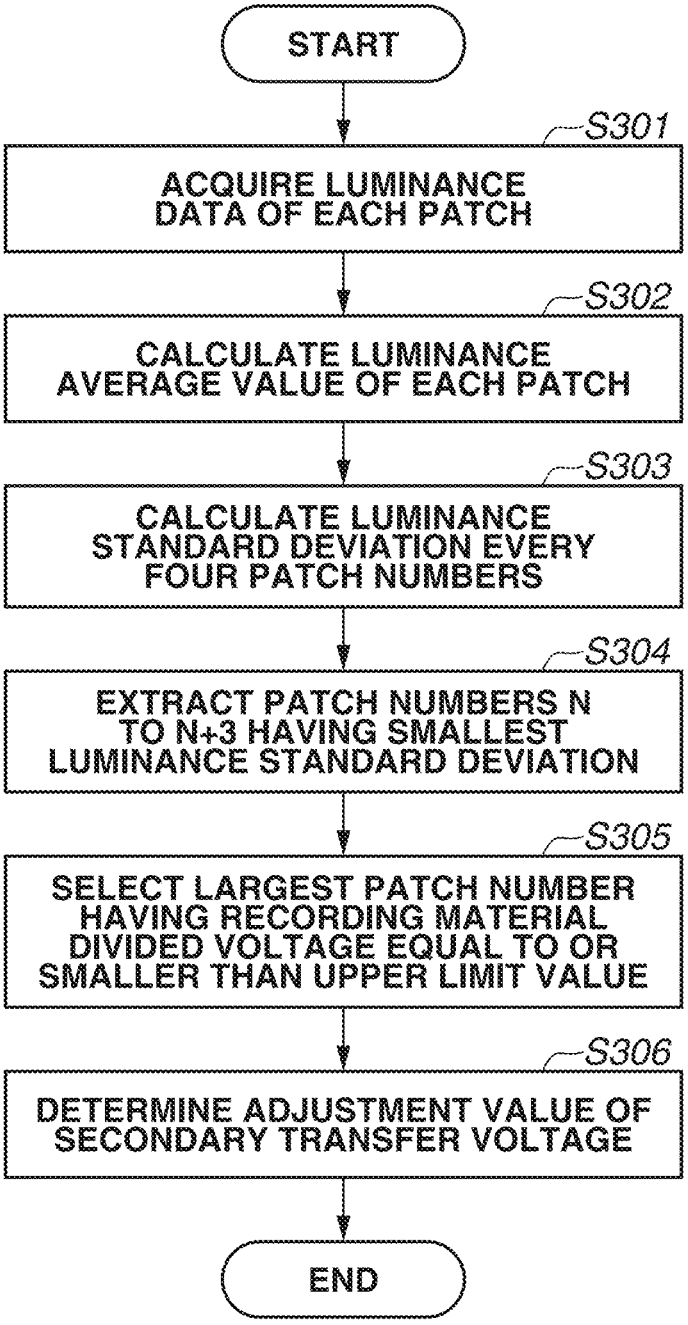
FIG. 10 is a flowchart illustrating a procedure of determination processing of an adjustment value according to the first exemplary embodiment.

Next, the processing of determining an adjustment value of a secondary transfer voltage in step S218 of FIG. 8 will be described. FIG. 10 is a flowchart schematically illustrating an example of a procedure of the processing. The description will be given of an example case where two small charts 100S being one-sided charts are read by the image reading device 80. The description will be given of an example case where luminance data of the blue solid patch 101 is used as density information (luminance information) of a patch for determining an adjustment value of a secondary transfer voltage. For the sake of convenience, the description will be given assuming that the above-described adjustment values −4 to 0 to +5 respectively correspond to patch numbers 1 to 10.

Figure 11:
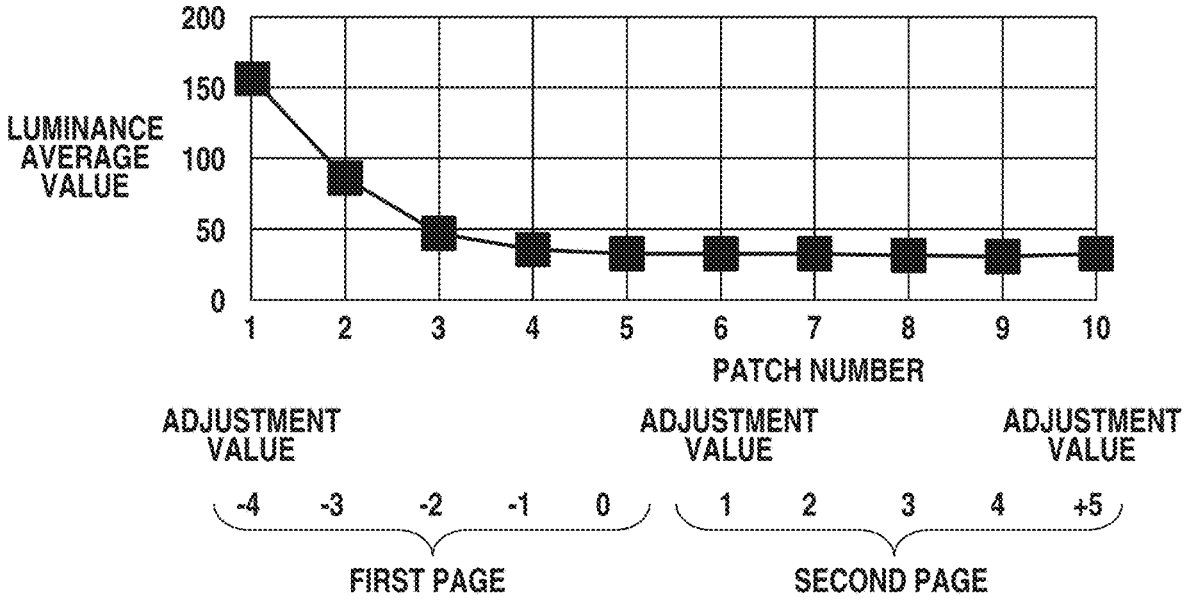
FIG. 11 illustrates a graph indicating an example of a relationship between a luminance average value of a patch and a test voltage.

In step S301, the control unit 30 acquires RGB luminance data (8 bits) of each blue solid patch read from the two small charts 100S set on the image reading device 80 by the operator, and stored in the RAM 33. Next, in step S302, the control unit 30 calculates a luminance average value Lave_B (N) (N=1 to 10) of each patch using the luminance data acquired in step S301. By the processing in step S302, for example, information indicating a relationship between a patch number (voltage level, adjustment value) and a luminance average value of a patch as illustrated in FIG. 11 is acquired. Next, in step S303, the control unit 30 calculates a standard deviation Lave_stdev(n) (n=1 to 7) of luminance average values every four patch numbers (N to N+3) sequentially from patches with small patch numbers to patches with large patch numbers. Next, in step S304, the control unit 30 extracts patch numbers N to N+3 (luminance stable region) having the smallest standard deviation Lave_stdev(n) of luminance average values. Next, in step S305, the control unit 30 selects the largest patch number among patch numbers having the recording material divided voltage Vp+ΔV (absolute value) that is determined from an adjustment value corresponding to each patch number extracted in step S304 and is equal to or smaller than a predetermined upper limit value. In other words, the control unit 30 selects an adjustment value having the smallest luminance average value (largest density) of the blue solid patch 101 without the recording material divided voltage Vp+ΔV exceeding the upper limit value. The above-described upper limit value is preset in accordance with a paper type category of the recording material S, for example, from the perspective of the prevention of an image defect caused by a too high secondary transfer voltage. Then, in step S306, the control unit 30 determines an adjustment value corresponding to the patch number selected in step S305, as a candidate of a desirable setting of a secondary transfer voltage, and stores the adjustment value into the RAM 33. By such processing, an adjustment value corresponding to a patch number 4, for example, where a decline in luminance average value (increase in density) stops in FIG. 11 is determined as a candidate.

The processing of determining adjustment values for the first surface and the second surface of the recording material S based on the reading results of the first surface and the second surface of each of the two small charts 100S being two-sided charts is similar to the above-described processing. The processing of determining an adjustment value based on a reading result of one large chart 100L (one-sided chart or both surfaces of two-sided chart) is also similar to the above-described processing except that the number of patch sets is different.

The color of patches of which luminance data is to be acquired is not limited to blue. Aside from blue patches, red patches or green patches may be used, or monochrome solid patches of Y, M, C, or K may be used. Alternatively, halftone luminance data may be acquired.

In the present exemplary embodiment, an adjustment amount of a secondary transfer voltage is determined based on patches in the luminance stable region that have been extracted by sequentially obtaining standard deviations of patch luminance data every group of a plurality of patch numbers. Nevertheless, a method of determining an adjustment amount of a secondary transfer voltage is not limited to this method. For example, an adjustment amount of a secondary transfer voltage may be determined by sequentially obtaining a luminance difference between patches with neighboring patch numbers, and extracting patches in the luminance stable region that have the luminance difference equal to or smaller than a predetermined value.

6. Effect

As described above, the image forming apparatus 1 according to the present exemplary embodiment includes the image bearing member 51 bearing a toner image, the intermediate transfer member 44*b* onto which the toner image is primarily transferred from the image bearing member 51, the transfer member 45*b* forming the transfer portion N2 at which the toner image is secondarily transferred from the intermediate transfer member 44*b* onto the recording material S, the secondary transfer power source 76 applying a voltage to the transfer member 45*b*, the discharge unit 48 discharging the recording material S including an image formed by fixing the toner image transferred at the transfer portion N2, the image reading device 80 that can read density information of an image on a recording material set by an operator, and the control unit 30 that can execute an adjustment mode for adjusting a secondary transfer voltage to be applied to the transfer member 45*b* by the secondary transfer power source 76 in secondary transfer, by discharging, from the discharge unit 48, the recording material S on which a chart is formed by sequentially transferring a plurality of test images by applying a plurality of test voltages to the transfer member 45*b* by the secondary transfer power source 76. Then, in the present exemplary embodiment, in the adjustment mode, the control unit 30 can discharge, from the discharge unit 48, a first recording material on which a first chart is formed, and a second recording material on which a second chart is formed, read using the image reading device 80 density information of test images on the first and the second recording materials that are simultaneously set on the image reading device 80 by the operator, and output information regarding an adjustment amount of a secondary transfer voltage based on the density information of test images on the first and second charts that has been acquired from a reading result obtained by the image reading device 80. The image reading device 80 may include the platen glass 82 supporting the simultaneously-set first and second recording materials in such a manner that the image reading device 80 can execute reading. The image reading device 80 may also include the automatic document conveyance device 81 sequentially conveying the simultaneously-set first and second recording materials in such a manner that the image reading device 80 can execute reading.

The image forming apparatus 1 may include the two-sided conveyance unit 11 conveying, for transferring a toner image onto the second surface of a recording material S having the first surface including a fixed toner image, the recording material S to the secondary transfer portion N2, when forming images onto both surfaces of the recording material S. In this case, in the adjustment mode, the first recording material having the first surface including a formed first chart and the second surface including a formed third chart, and the second recording material having the first surface including a formed second chart and the second surface including a formed fourth chart can be discharged from the discharge unit 48. Then, in the case of using the above-described platen glass 82 of the image reading device 80, density information of test images on one surface of each of the first and the second recording materials simultaneously set on the image reading device 80 set by the operator can be read by the image reading device 80, and density information of test images on a different surface of each of the first and the second recording materials simultaneously set on the image reading device 80 by the operator can be read by the image reading device 80. Alternatively, in the case of using the above-described automatic document conveyance device 81 of the image reading device 80, density information of test images on one surface and a different surface of each of the first and the second recording materials simultaneously set on the image reading device 80 by the operator can be read by the image reading device 80. Then, the control unit 30 can output information regarding an adjustment amount of a secondary transfer voltage to be applied when an image is to be formed on the first surface of the recording material S, based on density information of test images on the first and second charts that has been acquired from a reading result obtained by the image reading device 80, and output information regarding an adjustment amount of a secondary transfer voltage to be applied when an image is to be formed on the second surface of the recording material S, based on density information of test images on the third and fourth charts that has been acquired from a reading result obtained by the image reading device 80.

The first chart may include a plurality of test images sequentially transferred from the upstream side toward the downstream side in the conveyance direction of the first recording material in forming the first chart, using a plurality of test voltages having absolute values varied to sequentially increase, and the second chart may include a plurality of test images sequentially transferred from the upstream side toward the downstream side in the conveyance direction of the second recording material in forming the second chart, using a plurality of test voltages having absolute values varied to sequentially increase from an absolute value larger than the largest absolute value among absolute values of the plurality of test voltages used in forming the first chart.

Alternatively, the first chart may include a plurality of test images sequentially transferred from the upstream side toward the downstream side in the conveyance direction of the first recording material in forming the first chart, using a plurality of test voltages having absolute values varied to sequentially decrease, and the second chart includes a plurality of test images sequentially transferred from the upstream side toward the downstream side in the conveyance direction of the second recording material in forming the second chart, using a plurality of test voltages having absolute values varied to sequentially decrease from an absolute value smaller than the smallest absolute value among absolute values of the plurality of test voltages used in forming the first chart. The control unit 30 can output the above-described information regarding an adjustment amount to the display unit 70*a* provided in the image forming apparatus 1, or a display unit of the external device 200 connected to the image forming apparatus 1, and display the information regarding the adjustment amount on the display unit. The control unit 30 can output the above-described information regarding an adjustment amount to the RAM 33 provided in the image forming apparatus 1, and store the information regarding the adjustment amount into the RAM 33. In the present exemplary embodiment, in the adjustment mode, the control unit 30 can discharge, from the discharge unit 48, one recording material that has a size larger than the respective sizes of the above-described first and second recording materials, and includes a chart formed by transferring a plurality of test images, and adjust a secondary transfer voltage based on a reading result of density information of test images on the one recording material that is obtained by the image reading device 80.

In addition, according to the present exemplary embodiment, also in the case of executing the adjustment mode using the recording material S with a small size such as the A4 size or the LTR size, usability can be enhanced by reducing the number of times the chart 100 is placed on the image reading device 80.

Next, a second exemplary embodiment of the present disclosure will be described. A basic configuration and operations of an image forming apparatus according to the present exemplary embodiment are the same as those of the image forming apparatus according to the first exemplary embodiment. Thus, in the image forming apparatus according to the present exemplary embodiment, the components having functions or configurations the same as or corresponding to those of the image forming apparatus according to the first exemplary embodiment are assigned reference numerals the same as those in the first exemplary embodiment, and detailed description will be omitted.

In the adjustment mode, in consideration of reduction in adjustment time and stability, it is desirable to output the chart 100 onto which patches are transferred while switching a secondary transfer voltage (test voltage) sequentially from a small absolute value to a large absolute value, or from a large absolute value to a small absolute value. Then, assuming that patches are arrayed in a predetermined order from the leading end side toward the posterior end side in a scan direction of the chart 100, for example, processing of obtaining an adjustment amount of a secondary transfer voltage by associating density information of patches read in this order, and information regarding a secondary transfer voltage (test voltage) is performed. Specifically, for example, as described in the first exemplary embodiment, a standard deviation of luminance average values corresponding to the respective patch numbers that are assumed to be acquired in accordance with a predetermined switch order of a secondary transfer voltage (test voltage) is obtained. Thus, if an arrangement order of a plurality of charts 100 (two small charts 100S in the present exemplary embodiment) on the image reading device 80, or a conveyance order (reading order) of the charts 100 in the automatic document conveyance device 81 differs from a preset predetermined order, a processing result becomes inappropriate.

In view of the foregoing, in the present exemplary embodiment, based on density information of at least one patch of each of the two small charts 100S read by the image reading device 80, association between density information of each patch and information regarding a secondary transfer voltage (test voltage) corresponding to each patch is optimized. Hereinafter, more detailed description will be given.

Figure 12A:
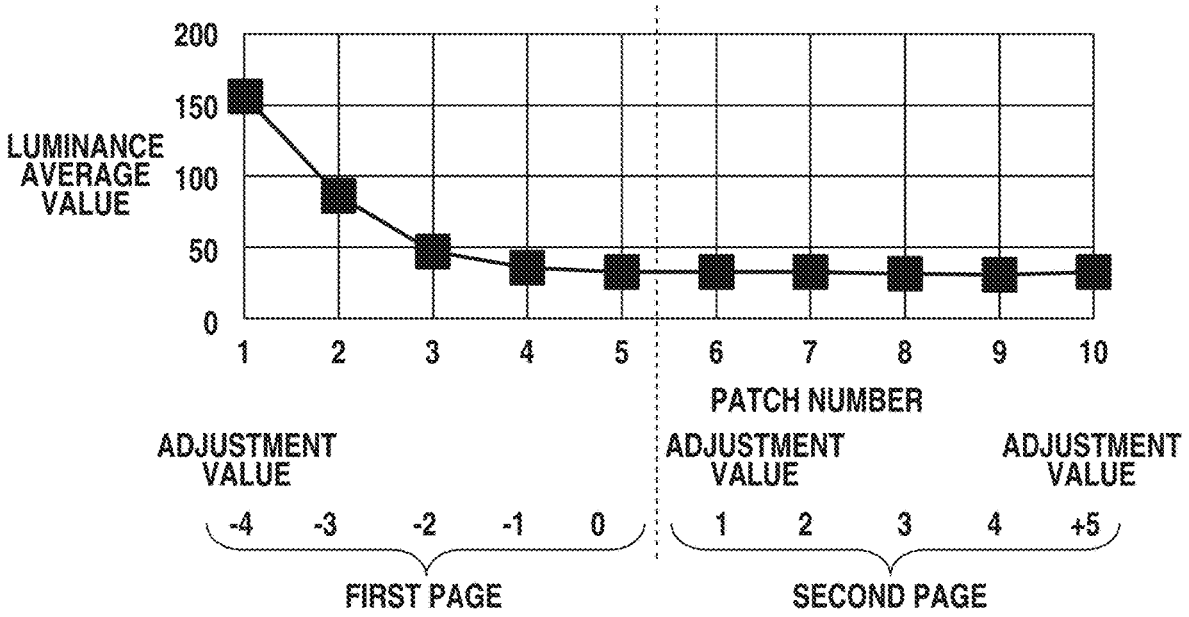
FIGS. 12A and 12B illustrate a graph indicating an example of a relationship between a luminance average value of a patch and a test voltage.

Similarly to FIG. 11, FIG. 12A illustrates a relationship between a patch number (voltage level, adjustment value) of the blue solid patch 101 and a luminance average value of a patch that is obtained in a case where the two small charts 100S being one-sided charts are read by the image reading device 80. For the sake of convenience, the description will be given assuming that the above-described adjustment values −4 to 0 to +5 respectively correspond to patch numbers 1 to 10.

In a case where the size of the recording material S used for outputting the chart 100 is a small size such as A4 landscape (297 mm×210 mm) or letter landscape (about 280 mm×216 mm), patches with patch numbers 1 to 5 are formed on the first small chart 100S, and patches with patch numbers 6 to 10 are formed on the second small chart 100S.

In a case where the two small charts 100S are set on the image reading device 80 by the operator by a predefined predetermined method, the control unit 30 can acquire information regarding a relationship between a patch number and a luminance average value as illustrated in FIG. 12A. The above-described predetermined method is, for example, a predetermined arrangement order of the two small charts 100S on the platen glass 82 of the image reading device 80 (for example, arranging the first chart on the left and the second chart on the right in such a manner that a plurality of patches is arrayed similarly to those on the large chart 100L). Alternatively, the above-described predetermined method is, for example, an overlap order of the two small charts 100S on the document stacking portion of the automatic document conveyance device 81 (for example, overlapping the first chart on the second chart). In other words, the above-described predetermined method is a conveyance order of the two small charts 100S in the automatic document conveyance device 81 (for example, initially conveying the first chart and then conveying the second chart later).

Figure 12B:
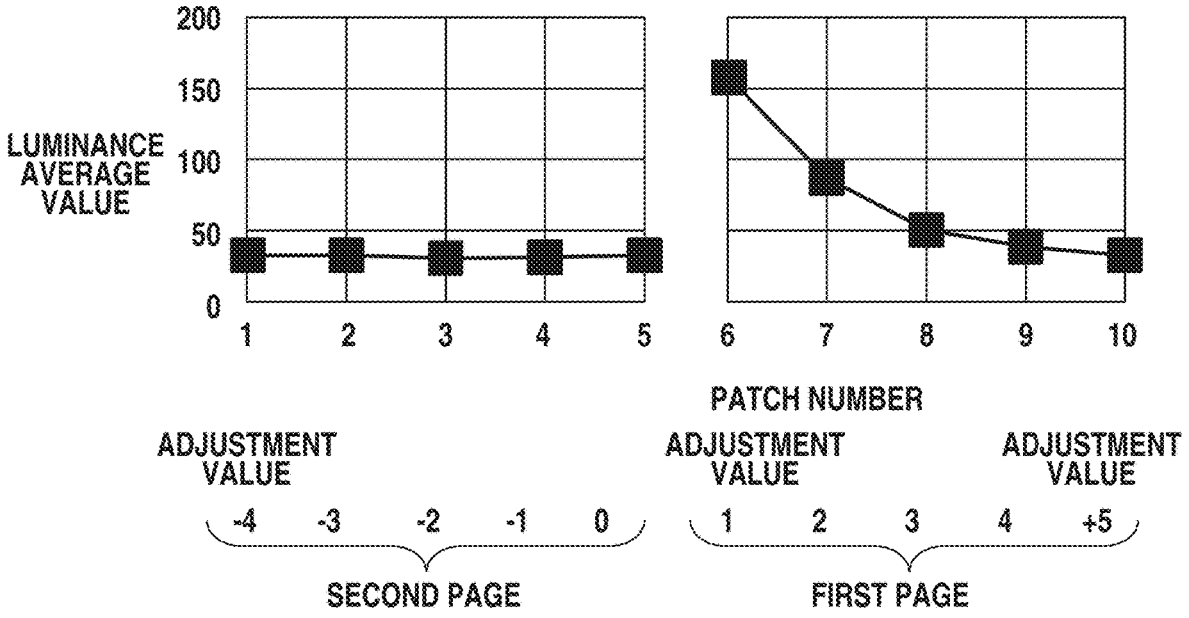

On the other hand, in a case where the two small charts 100S fail to be correctly set on the image reading device 80 by the operator by the above-described predetermined method, the following state is caused. For example, in a case where an arrangement order of the two small charts 100S on the platen glass 82 of the image reading device 80 is reverse to the order in the case of the above-described predetermined method, or in a case where a conveyance order of the two small charts 100S in the automatic document conveyance device 81 is reverse to the order in the case of the above-described predetermined method, the control unit 30 acquires information regarding a relationship between a patch number and a luminance average value as illustrated in FIG. 12B.

In this case, a luminance difference that cannot be originally generated is generated between luminance average values of patches with the patch number 5 and the patch number 6. It consequently becomes unable to correctly obtain a desirable adjustment value in the method of determining an adjustment value of a secondary transfer voltage as describes in the first exemplary embodiment (FIG. 10), for example.

In view of the foregoing, in the present exemplary embodiment, in a case where a luminance difference (difference between luminance average values) between patches with the patch number 5 and the patch number 6 is equal to or larger than a predetermined threshold value, the control unit 30 determines that a method of setting the two small charts 100S on the image reading device 80 is not correct. Then, the control unit 30 performs processing of counterchanging a group of luminance data of patch numbers 1 to 5, and a group of luminance data of patch numbers 6 to 10 that are acquired from the image reading device 80 and stored in the RAM 33.

Figure 13:
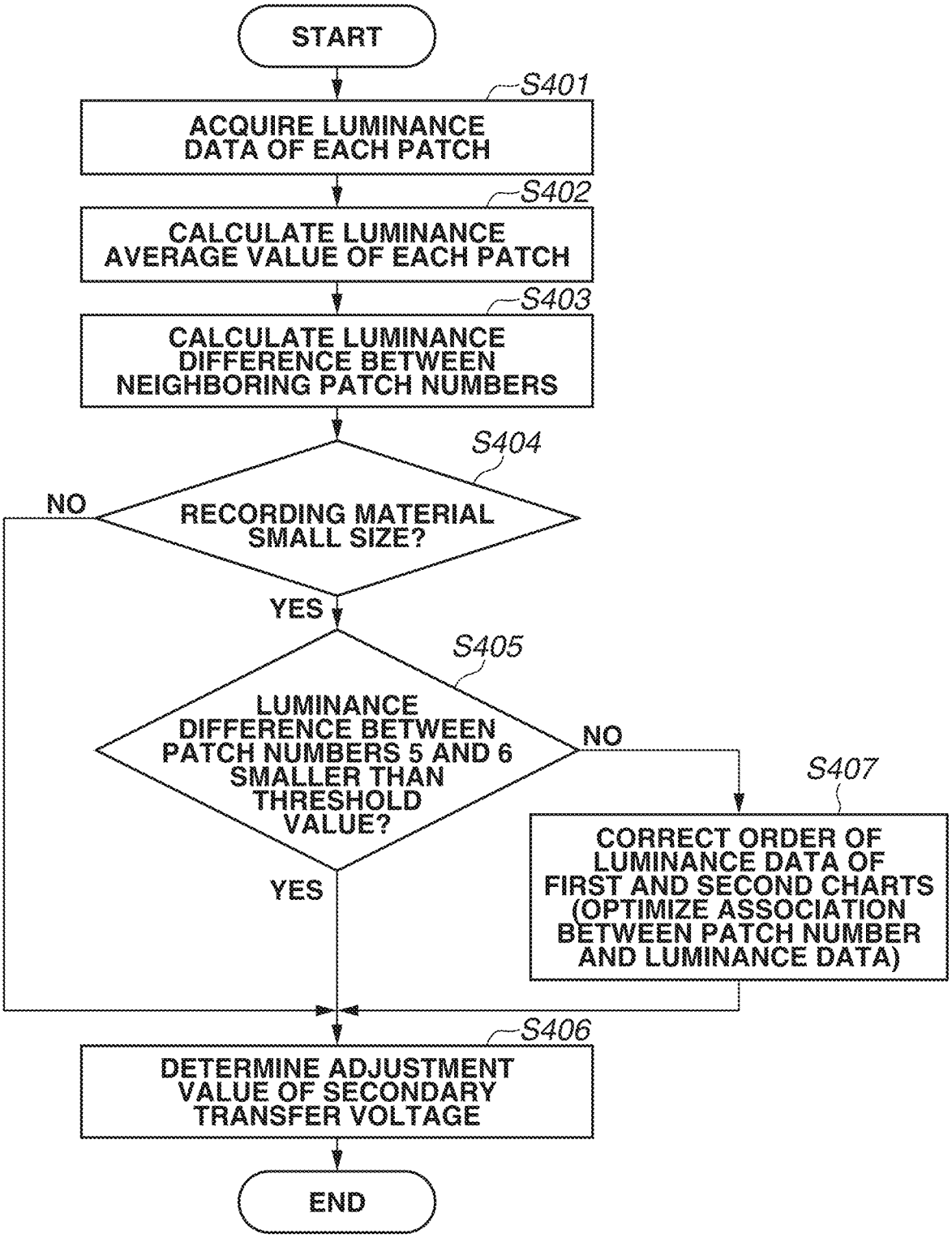
FIG. 13 is a flowchart illustrating a procedure of determination processing of an adjustment value according to a second exemplary embodiment.

Next, processing of determining an adjustment value of a secondary transfer voltage according to the present exemplary embodiment will be described. FIG. 13 is a flowchart schematically illustrating an example of a procedure of the processing. The processing illustrated in FIG. 13 is executed as processing in step S218 in the procedure of the adjustment mode that is illustrated in FIG. 8, and has been described in the first exemplary embodiment. The description will be given of an example case where one-sided charts are read. As a case where the charts 100 fail to be correctly set on the image reading device 80 by a predetermined method, the description will be given of an example case where an arrangement order on the image reading device 80 of the two small charts 100S being one-sided charts is reverse, or a conveyance order of the two small charts 100S in the automatic document conveyance device 81 is reverse. The description will be given of an example case where luminance data of the blue solid patch 101 is used as density information (luminance information) of a patch for determining an adjustment value of a secondary transfer voltage.

In step S401, the control unit 30 (the adjustment process unit 31*d*) acquires RGB luminance data (8 bits) of each blue solid patch read from the two small charts 100S set on the image reading device 80 by the operator, and stored in the RAM 33. At this time, the control unit 30 acquires luminance data of each patch assuming that patches are arrayed in a predetermined order from the leading end side to the posterior end side in the scan direction of the image reading device 80. Then, in step S402, the control unit 30 calculates a luminance average value Lave_B(N) (N=1 to 10) of each patch using the luminance data acquired in step S401, and stores the luminance average value into the RAM 33.

Next, in step S403, the control unit 30 calculates a luminance difference (difference between luminance average values) between patches with neighboring patch numbers based on the luminance average value stored into the RAM 33 in step S402. Next, in step S404, the control unit 30 determines whether the recording material S used for outputting the chart 100 is a small size. In a case where the control unit 30 determines in step S404 that the size of the recording material S used for outputting the chart 100 is a small size such as A4 landscape (297 mm×210 mm) or letter landscape (about 280 mm×216 mm) (YES in step S404), the processing proceeds to step S405.

Then, in step S405, the control unit 30 determines whether the luminance difference between patches with the patch number 5 and the patch number 6 that has been calculated in step S403 is smaller than a predetermined threshold value. The predetermined threshold value is preset to a value corresponding to a measurement variation value of luminance values obtained by the image reading device 80 in a case where the two small charts 100S are correctly set on the image reading device 80 by the predetermined method, for example, and is stored in the ROM 32. Then, in a case where the control unit 30 determines in step S405 that the luminance difference is smaller than the predetermined threshold value (YES in step S405), the processing proceeds to step S406. In step S406, the control unit 30 determines an adjustment value of a secondary transfer voltage using the luminance average value of each patch that has been stored into the RAM 33 in step S402. The processing in step S406 may be the same as the processing in steps S303 to S306 of FIG. 10, which has been described in the first exemplary embodiment, for example.

On the other hand, in a case where the control unit 30 determines in step S405 that the luminance difference is not smaller than the predetermined threshold value (i.e., equal to or larger than the predetermined threshold value) (NO in step S405), the processing proceeds to step S407.

In this case, it can be determined that an arrangement order or a conveyance order (reading order) of the first small chart 100S and the second small chart 100S is not correct. In this case, in step S407, the control unit 30 counterchanges data corresponding to the patch numbers 1 to 5 on the first small chart 100S, and data corresponding to the patch numbers 6 to 10 on the second small chart 100S, in data of the luminance average value of each patch that has been stored into the RAM 33 in step S402. At this time, association between the luminance data acquired in step S401 and a patch number may be optimized, and a luminance average value may be calculated using the optimized luminance data. In other words, association between a patch number and luminance data is optimized by correcting an arrangement order of luminance data in such a manner that each patch number correctly corresponds to a secondary transfer voltage (test voltage). After that, in step S406, the control unit 30 determines an adjustment value of a secondary transfer voltage using a luminance average value of each patch of which association with a patch number has been optimized in step S407. As described above, the processing in step S406 may be the same as the processing in steps S303 to S306 of FIG. 10, which has been described in the first exemplary embodiment, for example.

In a case where the control unit 30 determines in step S404 that the size of the recording material S used for outputting the chart 100 is a large size such as the A3 size (297 mm×420 mm) or Ledger (about 280 mm×432 mm) (NO in step S404), the processing proceeds to step S406.

The color of patches of which luminance data is to be acquired is not limited to blue. Aside from blue patches, red patches or green patches may be used, or monochrome solid patches of Y, M, C, or K may be used. Alternatively, halftone luminance data may be acquired.

The description has been given of an example case where an arrangement order or a conveyance order of the two small charts 100S being one-sided chart is reverse, as a case where the charts 100 fail to be correctly set on the image reading device 80 by the predetermined method. Nevertheless, the case is not limited to this. The case where the charts 100 fail to be correctly set on the image reading device 80 by the predetermined method includes the following case. The case includes a case where an arrangement order or a reading order of at least one of a plurality of charts 100 is not correct, a case where an arrangement orientation of at least one of a plurality of charts 100 is not correct, a case where a placed surface of at least one of a plurality of charts 100 is not correct, or a combination of these. The case typically includes the following case. The case includes a case where an arrangement order or a reading order of the first and second charts 100 is reverse (corresponding to the above-described example), a case where an arrangement orientation of at least one of the first and second charts 100 is reverse, a case where a placed surface of at least one of the first and second charts 100 (arrangement order or reading order of the first surface and the second surface) is reverse, or a combination of these. By presetting a threshold value corresponding to each of these cases, as the above-described predetermined threshold value, in any case, association between a patch number and luminance data can be optimized by correcting an arrangement order of luminance data.

In the above description, it is determined whether a method of setting the charts 100 onto the image reading device 80 is correct, using density information of the most downstream patch in the conveyance direction of the first chart 100, and the most upstream patch in the conveyance direction of the second chart 100. Nevertheless, the determination method is not limited to this. It can be determined whether a method of setting the charts 100 onto the image reading device 80 is correct, based on density information of at least one arbitrary patch of each of a plurality of charts 100.

For example, it can be determined whether a setting method is correct, using density information of the most upstream patch in the conveyance direction of the first chart 100, and the most downstream patch in the conveyance direction of the second chart 100. In other words, referring to FIG. 12B, in the above-described example, it is determined that a setting method is not correct, in a case where a difference between density information of the most downstream patch of the first chart, and density information of the most upstream patch of the second chart is equal to or larger than a predetermined threshold value. In contrast to this, referring to FIG. 12B, it can also be determined that a setting method is not correct, in a case where a difference between density information of the most upstream patch of the first chart, and density information of the most downstream patch of the second chart is smaller than a predetermined threshold value. It is only required to use density information of patches with which it is easier to determine whether a setting method is correct in each of the above-described cases where a setting method is not correct. The determination is not limited to determination made based on a difference in density information between patches, and the determination can also be made by an arbitrary comparison method such as a difference in density information including a comparison for determining larger density information, or a ratio between pieces of density information. Pieces of density information of a plurality of patches of each of a plurality of charts 100 may be used.

Whether a set method of each chart 100 is correct, such as whether an arrangement orientation of at least one of a plurality of charts 100 is reverse, may be determined based on density information of at least one patch in a corresponding chart 100. For example, referring to FIG. 12A, in a case where an arrangement orientation of the first chart is reversed, a luminance average value increases as a patch number increases, in contrast to the transition illustrated in FIG. 12A. Such transition in luminance average value can be obtained from, for example, pieces of density information of a plurality of patches in each chart 100 (for example, a standard deviation or a difference in density information is sequentially obtained, or obtained from a difference in density information between the most upstream and the most downstream patches). Then, it can be determined whether an arrangement orientation of each chart 100 is correct, based on the result.

As described above, in the present exemplary embodiment, the control unit 30 determines which chart of the first chart and the second chart a result read by the image reading device 80 corresponds to, based on a reading result obtained by the image reading device 80, and outputs information regarding an adjustment amount of a secondary transfer voltage based on a reading result obtained by the image reading device 80 and the obtained determination result. In the present exemplary embodiment, the control unit 30 performs processing for outputting information regarding an adjustment amount of a secondary transfer voltage, by associating density information of a plurality of test images acquired from the image reading device 80, and information indicating a plurality of test voltages in such a manner that density information of each test image corresponds to a test voltage applied when a corresponding test image is transferred. In the present exemplary embodiment, the control unit 30 can perform processing of optimizing association between density information of a plurality of test images that is acquired from the image reading device 80 in a case where the first and the second recording materials fail to be set on the image reading device 80 by the operator by a predefined predetermined method, and a plurality of test voltages in such a manner that density information of each test image corresponds to a test voltage applied when a corresponding test image is transferred, based on density information of at least one test image of a plurality of test images read from one recording material S of the first and second recording materials, and density information of at least one test image of a plurality of test images read from a different recording material S of the first and second recording materials. Especially in the present exemplary embodiment, the control unit 30 performs the above-described optimization processing based on first density information acquired from the image reading device 80, which is density information of the most downstream test image in the conveyance direction of the first recording material in forming the first chart, in a case where the first and second recording materials are set on the image reading device 80 by the operator by the above-described predetermined method, and based on second density information acquired from the image reading device 80, which is density information of the most upstream test image in the conveyance direction of the second recording material in forming the second chart, in a case where the first and second recording materials are set on the image reading device 80 by the operator by a predetermined method. In the present exemplary embodiment, the control unit 30 performs the above-described optimization processing in a case where a difference between a density indicated by the first density information, and a density indicated by the second density information is equal to or larger than a predetermined threshold value. The optimization processing may include processing of counterchanging density information acquired from the image reading device 80 as density information of a test image of the first chart, and a density information acquired from the image reading device 80 as density information of a test image of a second chart. Identification information indicating at least one of the first surface or the second surface is formed on the first and second recording materials, and the control unit 30 may determine whether density information of a test image acquired from the image reading device 80 is density information of a test image on the first surface of the recording material or density information of a test image on the second surface of the recording material, based on the identification information read by the image reading device 80.

Then, according to the present exemplary embodiment, an effect similar to that of the first exemplary embodiment can be obtained, and it is possible to prevent a trouble caused by a mistake in an arrangement order or a reading order of the charts 100 that is made when the adjustment mode is executed using the recording material S with a small size.

Next, a third exemplary embodiment of the present disclosure will be described. A basic configuration and operations of an image forming apparatus according to the present exemplary embodiment are the same as those of the image forming apparatus according to the first exemplary embodiment. Thus, in the image forming apparatus according to the present exemplary embodiment, the components having functions or configurations the same as or corresponding to those of the image forming apparatus according to the first exemplary embodiment are assigned reference numerals the same as those in the first exemplary embodiment, and detailed description will be omitted.

In the second exemplary embodiment, based on density information of a patch, a reading order (page) of a chart and the arrangement (orientation) of a chart are determined. Nevertheless, in a case where a change in density between patches is small, a processing result might become inappropriate. Because it is difficult to determine the first surface or the second surface of a two-sided chart based only on density information of a patch, a processing result might become inappropriate, or an instruction to a user might become complicated.

In view of the foregoing, in the present exemplary embodiment, the arrangement of a chart and a reading order of a chart are optimized based on identification information of a chart read by the image reading device 80. Hereinafter, more detailed description will be given.

FIGS. 14A and 14B, and FIGS. 15A, 15B, 15C, and 15D are schematic diagrams of the charts 100 according to the present exemplary embodiment. In the present exemplary embodiment, a posterior end identification patch 501 for determining the arrangement of the chart 100, and a page determination patch 502 for determining a reading order of the chart 100 are formed on the chart 100.

Figure 14A:
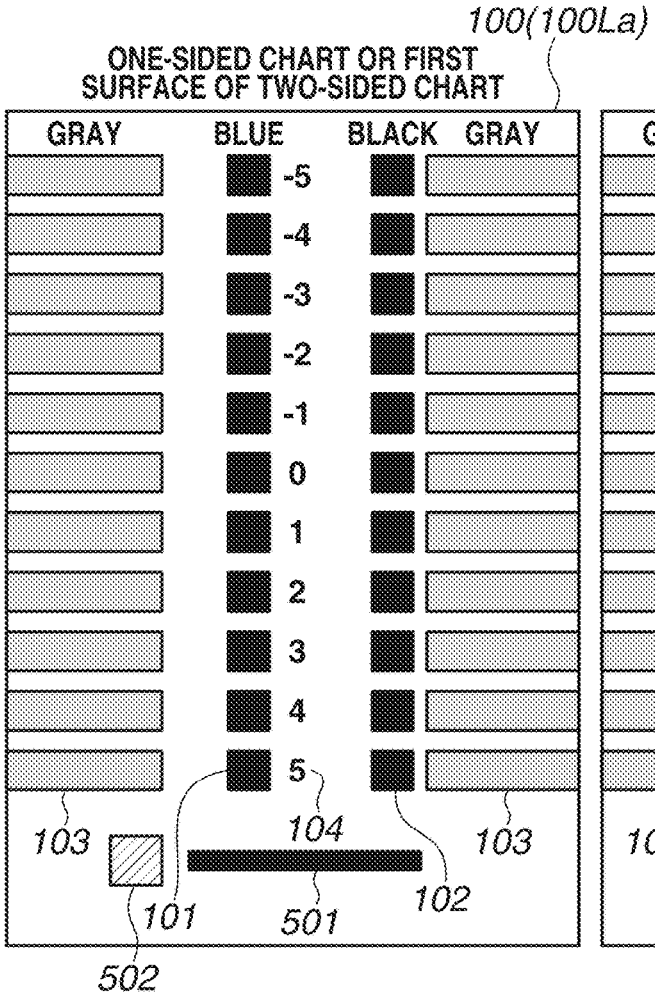
FIGS. 14A and 14B are schematic diagrams of another example of a chart for a large-sized recording material.
Figure 14B:
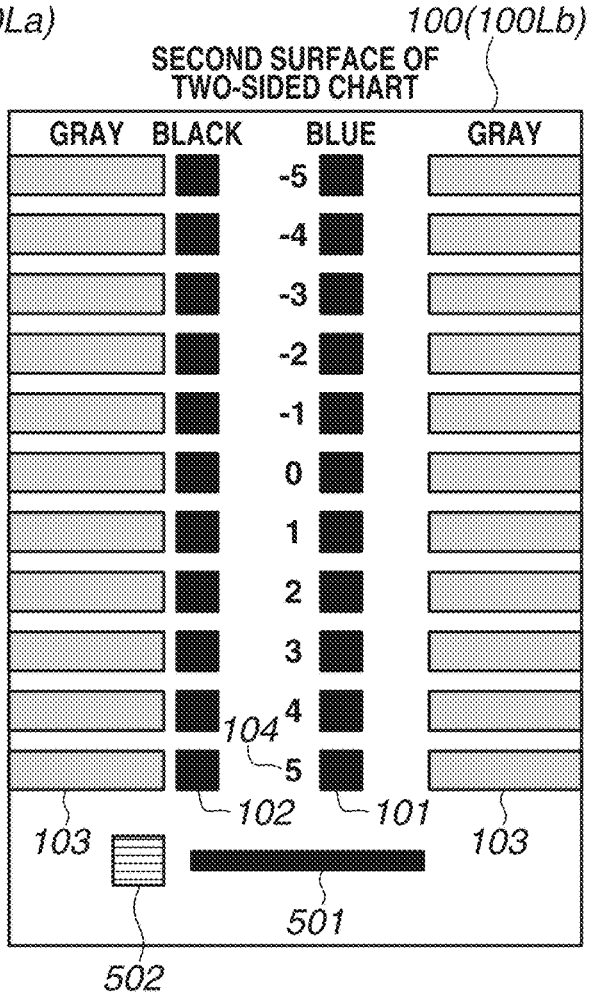
Figure 15A:
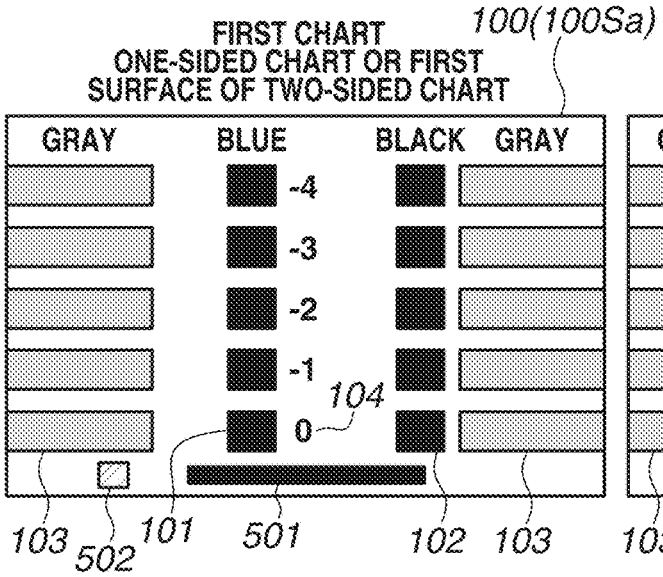
FIGS. 15A, 15B, 15C, and 15D are schematic diagrams of another example of a chart for a small-sized recording material.
Figure 15C:
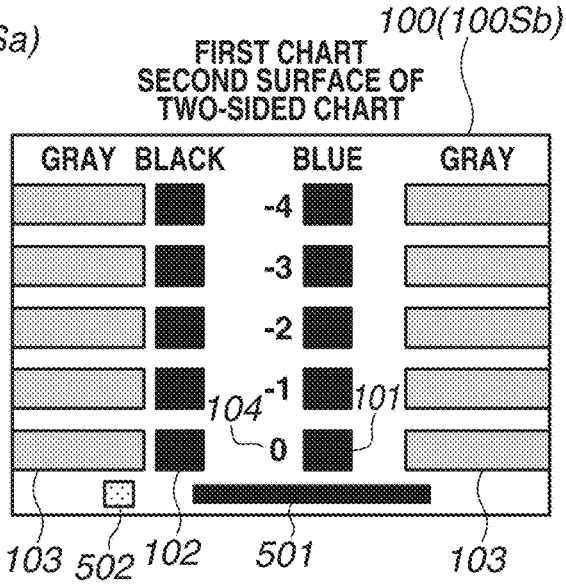
Figure 15B:
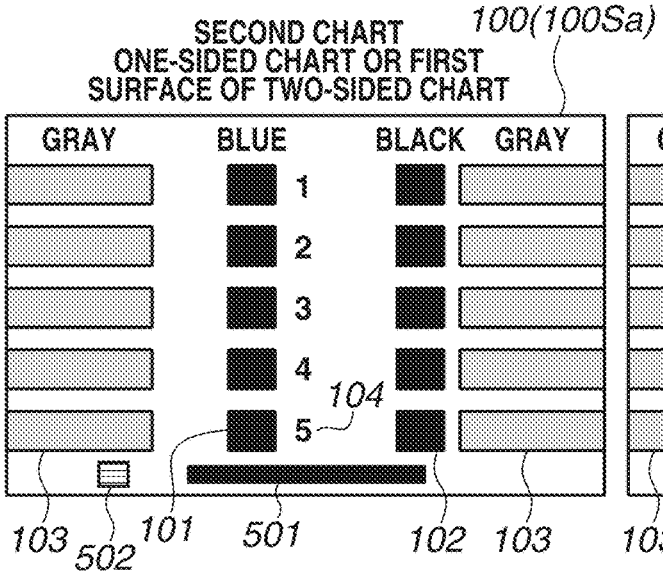
Figure 15D:
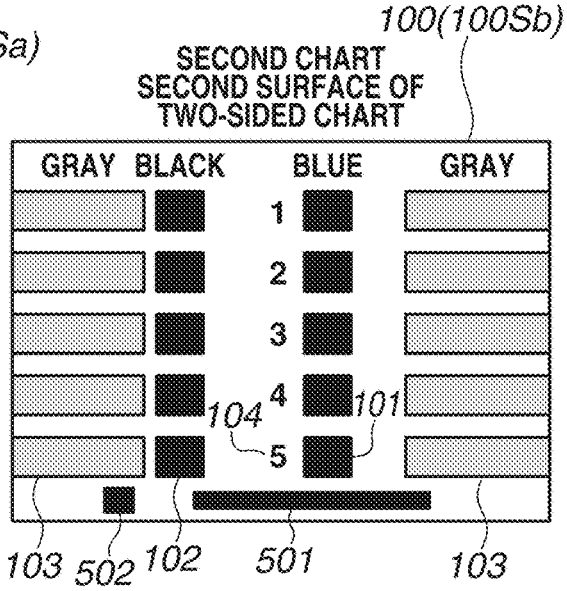

FIGS. 14A and 14B illustrate the large charts 100L on which the posterior end identification patch 501 and the page determination patch 502 are formed. FIG. 14A illustrates the large chart 100La output as a one-sided chart, or output as the first surface of a two-sided chart, and FIG. 14B illustrates the large chart 100Lb output as the second surface of a two-sided chart. On the other hand, FIGS. 15A, 15B, 15C, and 15D illustrate the small charts 100S on which the posterior end identification patch 501 and the page determination patch 502 are formed. FIG. 15A illustrates the small chart 100Sa output as the first one-sided chart or the first surface of the first two-sided chart. FIG. 15B illustrates the small chart 100Sa output as the second one-sided chart or the first surface of the second two-sided chart. FIG. 15C illustrates the small chart 100Sb output as the second surface of the first two-sided chart. FIG. 15D illustrates the small chart 100Sb output as the second surface of the second two-sided chart.

In all the charts 100, at the posterior end in the conveyance direction of the recording material S in forming the chart 100, a black belt being a belt-like image formed using black toner and extending in the main scanning direction is formed as the posterior end identification patch 501. With this configuration, the orientation (arrangement) of the chart 100 can be corrected based on the position of the posterior end identification patch 501 in the image read by the image reading device 80. In all the charts 100, the page determination patch 502 arranged adjacently to the posterior end identification patch 501 in the main scanning direction is formed.

In the present exemplary embodiment, a page (reading order) of the chart 100 is identified by the color of the page determination patch 502. The page determination patches 502 having different colors are formed on the respective pages of the charts illustrated in FIGS. 14A and 14B, and FIGS. 15A, 15B, 15C, and 15D. FIG. 16 illustrates a correspondence relationship between the color of the page determination patch 502 and each page (page number) of the chart 100 according to the present exemplary embodiment.

Next, processing of optimizing the arrangement of the chart 100 and a reading order of the chart 100 according to the present exemplary embodiment will be described. The processing is executed after reading processing of the chart 100 is executed by the image reading device 80 in a case where one two-sided large chart, two one-sided small charts, or two two-sided small charts are output, before processing of determining a recommended adjustment value of a secondary transfer voltage.

Figure 17:
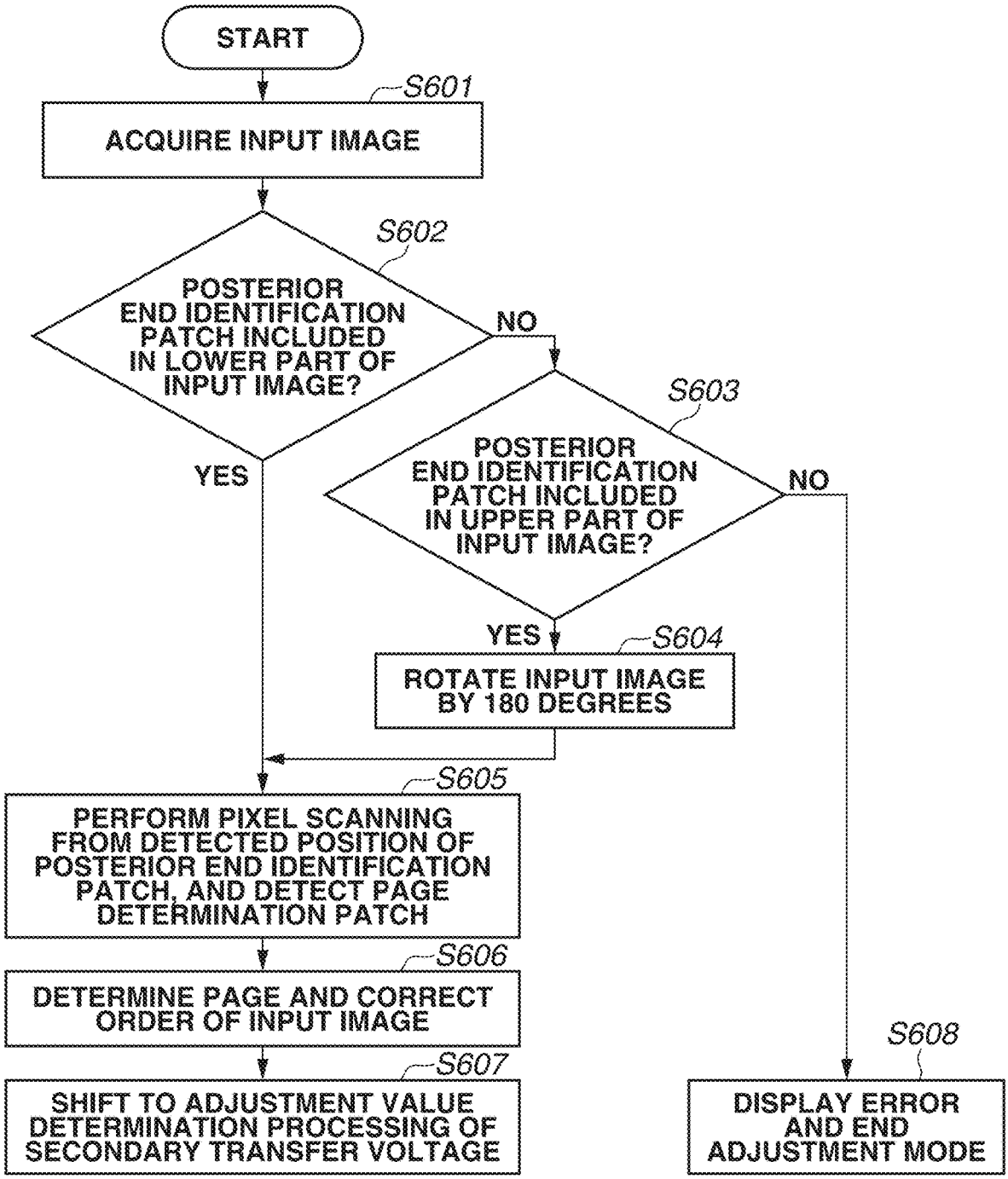
FIG. 17 is a flowchart of processing of optimizing the arrangement and an order of a read image according to a third exemplary embodiment.

In FIG. 17, at S601, the control unit 30 stores an input image read from the chart 100 set on the image reading device 80 by the operator, into the RAM 33. In step S602, the control unit 30 determines whether the posterior end identification patch 501 is included in a lower part of the read input image. The lower part of the input image is a position corresponding to the posterior end in the conveyance direction of the recording material S in forming the chart 100 in a case where the chart 100 is set on the image reading device 80 at a regular orientation.

In a case where the control unit 30 determines that the posterior end identification patch 501 is included in a lower part of the input image (YES in step S602), the processing proceeds to step S605. On the other hand, in a case where the control unit 30 determines that the posterior end identification patch 501 is not included in a lower part of the input image (NO in step S602), the processing proceeds to step S603. In step S603, the control unit 30 determines whether the posterior end identification patch 501 is included in an upper part of the input image. The upper part of the input image is a position corresponding to the posterior end in the conveyance direction of the recording material S in forming the chart 100 in a case where the chart 100 is set on the image reading device 80 at a orientation reverse to the regular orientation.

In a case where the control unit 30 determines that the posterior end identification patch 501 is included in an upper part of the input image (YES in step S603), the processing proceeds to step S604. In step S604, the control unit 30 rotates the input image by 180 degrees, and stores the rotated image into the RAM 33. Then, the processing proceeds to step S605. In other words, the control unit 30 optimizes the orientation of the input image stored in the RAM 33, in such a manner as to be the orientation of the chart 100 read at the regular orientation. On the other hand, in a case where the control unit 30 determines that the posterior end identification patch 501 is not included in an upper part of the input image (NO in step S603), the control unit 30 determines that the chart 100 set on the image reading device 80 is not a chart 100 for adjusting a secondary transfer voltage, and the processing proceeds to step S608. In step S608, the control unit 30 displays information indicating that an error has occurred, on the operation unit 70 or the display unit of the external device 200, and ends the adjustment mode.

In step S605, the control unit 30 performs pixel scanning of the image including the posterior end identification patch 501 at the lower part that is stored in the RAM 33, from a detected position of the posterior end identification patch 501, and detects the page determination patch 502. In step S606, the control unit 30 determines the page of the input image based on luminance information (i.e., determination result of color) of the detected page determination patch 502, and corrects the order of the input image as necessary. In other words, the control unit 30 optimizes association between each input image stored in the RAM 33, and a reading order in such a manner as to be a relationship between each chart 100 and a reading order that is set in a case where the chart 100 is read in a regular order. In a case where the order of the input image is a regular order, there is no need to correct the order. After that, in step S607, the control unit 30 advances the processing to processing of determining a recommended adjustment value of a secondary transfer voltage, which has been described in the first exemplary embodiment (refer to FIG. 10).

Figure 18:
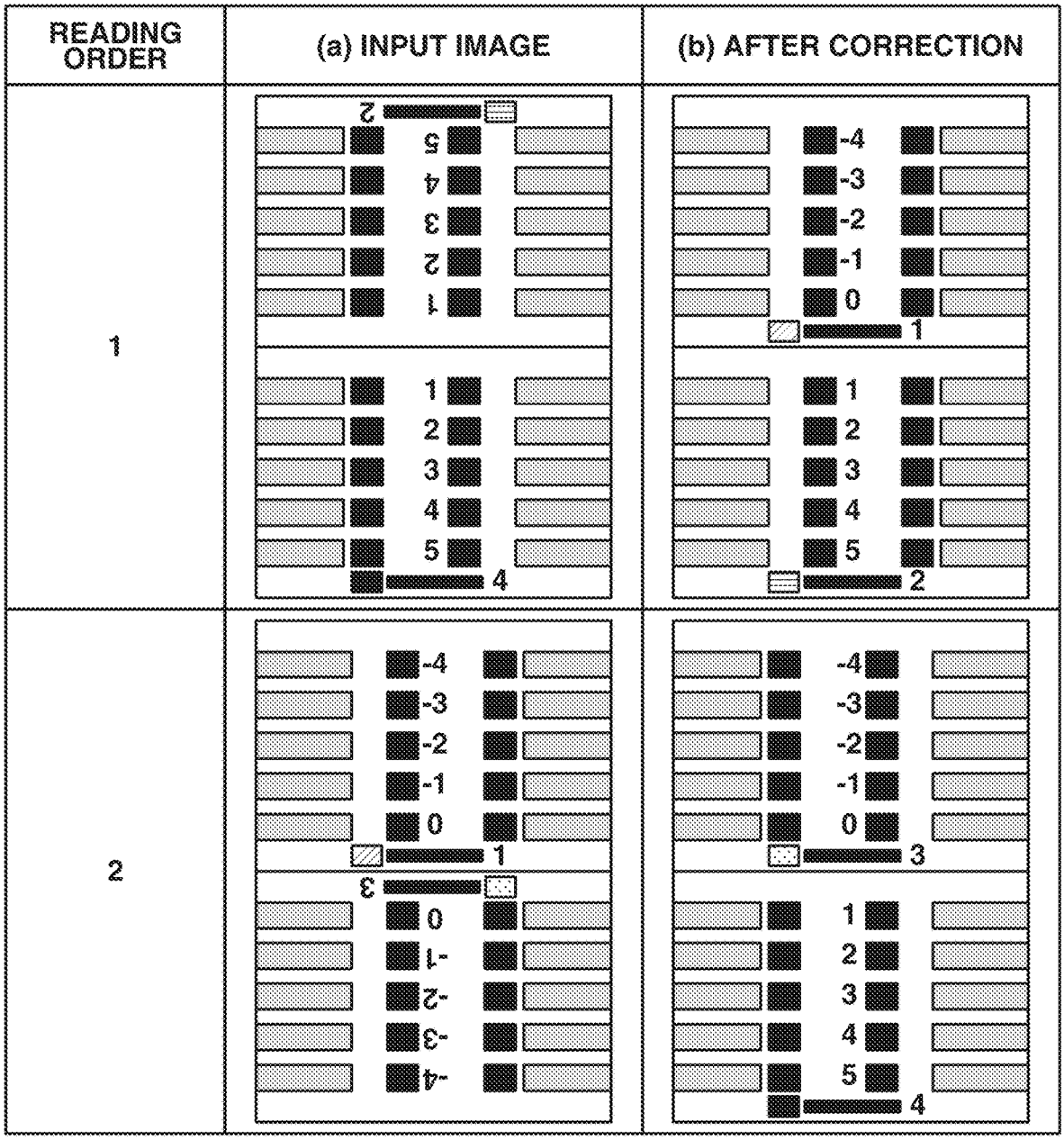
FIG. 18 is a diagram illustrating an effect according to the third exemplary embodiment.

FIG. 18 is an explanatory diagram illustrating an effect of the present exemplary embodiment. FIG. 18 illustrates an example case where two two-sided small charts are output and read by the image reading device 80. Input images listed in (a) of FIG. 18 are input images obtained by rearranging the charts 100 in such a manner that the arrangement (orientation) of the charts 100 and a reading order (page) of the charts 100 become different from the regular arrangement and reading order, and reading the charts 100 by the image reading device 80. Input images listed in (b) of FIG. 18 are input images obtained by correcting the arrangement of the charts 100 and a reading order of the charts 100 according to the present exemplary embodiment. As illustrated in FIG. 18, the orientation of the chart 100 and a reading order of the chart 100 can be optimized based on the posterior end identification patch 501 and the page determination patch 502 serving as identification information that are formed on the chart 100.

In the present exemplary embodiment, the posterior end identification patch 501 indicating a regular arrangement (orientation) of the chart 100 is formed at the posterior end in the conveyance direction of the recording material S in forming the chart 100, but the present disclosure is not limited to this configuration. The posterior end identification patch 501 indicating a regular arrangement (orientation) of the chart 100 may be formed at the leading end in the conveyance direction of the recording material S in forming the chart 100, or at the end in a direction intersecting with the conveyance direction, for example. In the present exemplary embodiment, the page identification patch 502 indicating a regular reading order (page) of the chart 100 is formed at a position different in the main scanning direction from that of the posterior end identification patch 501 indicating a regular arrangement (orientation) of the chart 100, and at least partially overlapping the posterior end identification patch 501 in the sub scanning direction. In other words, in the present exemplary embodiment, the page determination patch 502 and the posterior end identification patch 501 are formed side by side in the main scanning direction. With this configuration, a space on the surface of the recording material S on which the chart 100 is formed can be utilized more effectively for forming test images for density detection. Nevertheless, the present disclosure is not limited to this configuration. The page identification patch 502 indicating a regular reading order (page) of the chart 100 may be formed at a position different in the sub scanning direction from that of the posterior end identification patch 501 indicating a regular arrangement (orientation) of the chart 100 (position at least partially overlapping or different in the main scanning direction), for example.

In the present exemplary embodiment, the posterior end identification patch 501 indicating a regular arrangement (orientation) of the chart 100 and the page identification patch 502 indicating a regular reading order (page) of the chart 100 are separately provided. Nevertheless, the present disclosure is not limited to this configuration. The posterior end identification patch 501 indicating a regular arrangement (orientation) of the chart 100 and the page identification patch 502 indicating a regular reading order (page) of the chart 100 may be integrally formed. For example, a belt-like image similar to the posterior end identification patch 501 in the present exemplary embodiment can be formed in color different for each chart similarly to the page determination patch 502 in the present exemplary embodiment. Any one of the posterior end identification patch 501 indicating a regular arrangement (orientation) of the chart 100 and the page identification patch 502 indicating a regular reading order (page) of the chart 100 can be provided. Also in this case, at least one of the regular arrangement (orientation) of the chart 100 or the regular reading order (page) of the chart 100 can be determined, and an equivalent effect can be obtained.

As described above, in the present exemplary embodiment, in the adjustment mode, the control unit 30 can form the charts 100 on both surfaces of one recording material S as a plurality of surfaces of the recording material S, and discharge the recording material S from the discharge unit 48, or form the charts 100 on one surfaces or both surfaces of a plurality of recording material S as a plurality of surfaces of the recording material S, and discharge the plurality of recording materials S from the discharge unit 48, read density information of test images of the charts 100 on the above-described plurality of surfaces of the recording materials S simultaneously set on the image reading device 80 by the operator, using the image reading device 80, and output information regarding an adjustment amount of a secondary transfer voltage based on a reading result obtained by the image reading device 80. In the present exemplary embodiment, the posterior end identification patch 501 or page identification information 502 indicating at least one of a regular orientation of the chart 100 on each of the above-described plurality of surfaces, or a regular reading order of the charts 100 formed on the above-described plurality of surfaces in the image reading device 80 is formed on each of the above-described plurality of surfaces. Then, the control unit 30 outputs information regarding an adjustment amount of a secondary transfer voltage based on a reading result of density information of test images on the charts 100 on the above-described plurality of surfaces that is obtained by the image reading device 80, and a reading result of the posterior end identification patch 501 or page identification information 502 on the above-described plurality of surfaces that is obtained by the image reading device 80.

Then, according to the present exemplary embodiment, an effect similar to that of the first exemplary embodiment can be obtained, and it is possible to prevent a trouble caused by a mistake in arrangement of the chart 100 or a reading order of the chart 100.

[Others]

Heretofore, specific exemplary embodiments of the present disclosure have been described, but the present disclosure is not limited to the above-described exemplary embodiments.

In the above-described exemplary embodiments, a secondary transfer voltage is adjusted using an adjustment value corresponding to a predetermined adjustment amount. For example, an adjustment amount may be directly set via a setting screen.

In the above-described exemplary embodiments, the configuration of performing constant voltage control of a secondary transfer voltage has been described, but constant current control of a secondary transfer voltage may be performed. In the above-described exemplary embodiments, in the configuration of performing constant voltage control of a secondary transfer voltage, a secondary transfer voltage is adjusted by adjusting a target voltage in applying a secondary transfer voltage in the adjustment mode. In the configuration of performing constant current control of a secondary transfer voltage, a secondary transfer voltage can be adjusted by adjusting a target current in applying a secondary transfer voltage in the adjustment mode.

In the above-described exemplary embodiments, the description has been given of a case where charts are output by being formed on two recording materials in a case where the size of a recording material is a small size. The present disclosure can also be applied to a case where charts are output by being formed on three or more recording materials. The first chart and the second chart in the present disclosure include charts formed on arbitrary two recording materials (first and second recording materials) in a case where charts are output by being formed on three or more recording materials.

The present disclosure is not limited to a tandem-type image forming apparatus, and can also be applied to an image forming apparatus of another system. The image forming apparatus is not limited to a full-color image forming apparatus, and may be a monochrome or monocolor image forming apparatus. The present disclosure can be applied to various intended purposes such as a printer, various printing machines, a copier, a FAX, and a multi-function peripheral.

According to an exemplary embodiments of the present disclosure, usability can be enhanced by reducing the number of times a chart is placed on a image reading device.

While the present disclosure has been described with reference to exemplary embodiments, it is to be understood that the disclosure is not limited to the disclosed exemplary embodiments. The scope of the following claims is to be accorded the broadest interpretation so as to encompass all such modifications and equivalent structures and functions.

This application claims the benefit of priority from Japanese Patent Applications No. 2020-210847, filed Dec. 18, 2020, and No. 2021-082768, filed May 14, 2021, which are hereby incorporated by reference herein in their entirety.

What is claimed is:

1. An image forming apparatus comprising:

an image bearing member configured to bear a toner image;

a transfer member configured to transfer a toner image onto a recording material from the image bearing member;

an application unit configured to apply a voltage to the transfer member;

a platen on which a recording material is disposed when an image on the recording material is to be read;

a reading device configured to read an image on a recording material disposed on the platen; and a control unit configured to execute an adjustment mode for adjusting a transfer voltage to be applied to the transfer member, wherein, in the adjustment mode, the control unit outputs a first chart formed by transferring a plurality of first test images to a first recording material by applying a plurality of first test voltages to the transfer member, and a second chart formed by transferring a plurality of second test images to a second recording material by applying a plurality of second test voltages to the transfer member, and is configured to adjust the transfer voltage applied to the transfer member based on a reading result of the reading device when the first recording material and the second recording material set together on the platen are read by the reading device.

2. The image forming apparatus according to claim 1, further comprising a display unit configured to display information prompting an operator to set the first recording material and the second recording material together on the platen in the adjustment mode.

3. The image forming apparatus according to claim 1, wherein first identification information for identifying an orientation of the first chart is formed on a surface on which the first test images are formed, and second identification information for identifying an orientation of the second chart is formed on a surface on which the second test images are formed, and wherein the control unit is configured to adjust the transfer voltage based on a reading result of the first test images, the second test images, the first identification information, and the second identification information that is obtained by the reading device.

4. The image forming apparatus according to claim 1, wherein first identification information for identifying page information of the first chart is formed on a surface on which the first test images are formed, and second identification information for identifying page information of the second chart is formed on a surface on which the second test images are formed, and wherein the control unit is configured to adjust the transfer voltage based on a reading result of the first test images, the second test images, the first identification information and the second identification information that is obtained by the reading device.

5. An image forming apparatus comprising:

an image bearing member configured to bear a toner image;

a transfer member configured to transfer a toner image onto a recording material from the image bearing member;

an application unit configured to apply a voltage to the transfer member;

a reading device configured to read an image on a recording material; and a control unit configured to execute an adjustment mode for adjusting a transfer voltage to be applied to the transfer member, wherein, in the adjustment mode, the control unit outputs a first chart formed by transferring a plurality of first test images to a first recording material by applying a plurality of first test voltages to the transfer member, and a second chart formed by transferring a plurality of second test images to a second recording material by applying a plurality of second test voltages to the transfer member, and forms first identification information for identifying an orientation of the first chart on a surface on which the first test images are formed, and second identification information for identifying an orientation of the second chart is formed on a surface on which the second test images are formed, and wherein the control unit is configured to adjust the transfer voltage based on a reading result of the first test images, the second test images, the first identification information, and the second identification information that is obtained by the reading device.

6. The image forming apparatus according to claim 5, wherein third identification information for identifying a page of the first chart is formed on a surface on which the first test images are formed, and fourth identification information for identifying a page of the second chart is formed on a surface on which the second test images are formed, and wherein the control unit is configured to adjust the transfer voltage based on a reading result of the third identification information and the fourth identification information that is obtained by the reading device.

7. The image forming apparatus according to claim 6, wherein the third identification information and the fourth identification information are patch images formed using toners of different colors.

8. The image forming apparatus according to claim 6, wherein the first identification information and the third identification information are formed at different positions.

9. The image forming apparatus according to claim 8, wherein, in a width direction orthogonal to an array direction of the plurality of first test images, the first identification information and the third identification information are arranged.

10. The image forming apparatus according to claim 5, wherein the reading device includes a platen on which a recording material is disposed, and, in the adjustment mode, the control unit is configured to adjust the transfer voltage applied to the transfer member based on the reading result when the first recording material and the second recording material set together on the platen are read by the reading device.

11. The image forming apparatus according to claim 10, wherein, in the adjustment mode, whether the first recording material is set in a first direction on the platen or the first recording material is set in a second direction, opposite to the first direction, on the platen, the control unit is configured to adjust the transfer voltage based on the reading result of the first test images, the second test images, the first identification information, and the second identification information that is obtained by the reading device.

12. The image forming apparatus according to claim 5, wherein the reading device includes a conveyance portion configured to sequentially and automatically convey the first recording material and the second recording material to the reading unit, and a reading portion configured to read an image on a recording material sequentially and automatically conveyed by said conveyance portion, and in the adjustment mode, the control unit is configured to adjust the transfer voltage applied to the transfer member based on the reading result when the first recording material and the second recording material sequentially and automatically conveyed by said conveyance portion are read by the reading portion.

13. The image forming apparatus according to claim 5, wherein the first identification information and the second identification information are belt-like patch images formed using black toner.

14. An image forming apparatus comprising:

an image bearing member configured to bear a toner image;

a transfer member configured to transfer a toner image onto a recording material from the image bearing member;

an application unit configured to apply a voltage to the transfer member;

a reading device configured to read an image on a recording material; and a control unit configured to execute an adjustment mode for adjusting a transfer voltage to be applied to the transfer member, wherein, in the adjustment mode, the control unit outputs a first chart formed by transferring a plurality of first test images to a first recording material by applying a plurality of first test voltages to the transfer member, and a second chart formed by transferring a plurality of second test images to a second recording material by applying a plurality of second test voltages to the transfer member, and forms first identification information for identifying a page of the first chart on a surface on which the first test images are formed, and second identification information for identifying a page of the second chart on a surface on which the second test images are formed, and wherein the control unit is configured to adjust the transfer voltage based on a reading result of the first test images, and the second test images, and the first identification information and the second identification information that is obtained by the reading device.

15. The image forming apparatus according to claim 14, wherein the reading device includes a platen on which a recording material is disposed, and, in the adjustment mode, the control unit is configured to adjust the transfer voltage applied to the transfer member based on the reading result when the first recording material and the second recording material set together on the platen are read by the reading device.

16. The image forming apparatus according to claim 15, wherein, in a case where the first recording material or the second recording material is set in an order different from a regular page order, the control unit is configured to adjust the transfer voltage based on the reading result of the first test images, the second test images, the first identification information and the second identification information obtained by the reading device.

17. The image forming apparatus according to claim 14, wherein the reading device includes a conveyance portion configured to sequentially and automatically convey the first recording material and the second recording material to the reading unit, and a reading potion configured to read an image on a recording material sequentially and automatically conveyed by said conveyance portion, and in the adjustment mode, the control unit is configured to adjust the transfer voltage applied to the transfer member based on the reading result when the first recording material and the second recording material sequentially and automatically conveyed by said conveyance portion are read by the reading portion.

* * * * *